United States Patent [19]

Garrett

[11] 4,281,726

[45] Aug. 4, 1981

[54] DRILL STRING SPLINED RESILIENT TUBULAR TELESCOPIC JOINT FOR BALANCED LOAD DRILLING OF DEEP HOLES

[75] Inventor: William R. Garrett, Houston, Tex.

[73] Assignee: Smith International, Inc., Newport Beach, Calif.

[21] Appl. No.: 38,674

[22] Filed: May 14, 1979

[51] Int. Cl.[3] ..... E21B 17/07

[52] U.S. Cl. ..... 175/321; 267/162; 184/1 C; 175/40

[58] Field of Search ..... 267/161-162, 267/160; 184/1 C; 175/321, 40, 107, 297

[56] References Cited

U.S. PATENT DOCUMENTS

| | | | |
|---|---|---|---|
| 1,641,059 | 8/1927 | Tausch | 267/162 X |
| 2,675,225 | 4/1954 | Migny | 267/162 |
| 3,301,009 | 1/1967 | Coulter, Jr. | 175/321 |
| 3,375,000 | 3/1968 | Seamands et al. | 267/162 |
| 3,383,126 | 5/1968 | Salvatori | 175/321 |
| 3,670,319 | 6/1972 | Ohtani | 184/1 C |
| 3,949,150 | 4/1976 | Mason et al. | 175/321 |
| 4,074,775 | 2/1978 | Lee | 173/163 |
| 4,133,516 | 1/1979 | Jürgens | 175/321 |
| 4,139,994 | 2/1979 | Alther | 175/321 X |
| 4,162,619 | 7/1979 | Nixon, Jr. | 175/321 |
| 4,186,569 | 2/1979 | Aumann | 175/321 |
| 4,194,582 | 3/1980 | Ostertag | 175/321 |

*Primary Examiner*—William F. Pate, III

*Attorney, Agent, or Firm*—Murray Robinson; Ned L. Conley; David Alan Rose

[57] ABSTRACT

A drill string splined resilient tubular telescopic joint for balanced load deep well drilling comprises a double acting damper having a very low spring rate upon both extension and contraction from the zero deflection condition. Preferably the spring means itself is a double acting compression spring means wherein the same spring means is compressed whether the joint is extended or contracted. The damper has a like low spring rate over a considerable range of deflection, both upon extension and contraction of the joint, but a gradually then rapidly increased spring rate upon approaching the travel limits in each direction. Stacks of spring rings are employed for the spring means, the rings being either shaped elastomer-metal sandwiches or, preferably, roller Belleville springs. The spline and spring means are disposed in an annular chamber formed by mandrel and barrel members constituting the telescopic joint. The spring rings make only such line contact with one of the telescoping members as is required for guidance therefrom, and no contact with the other member. The chamber containing the spring means, and also containing the spline means, is filled with lubricant, the chamber being sealed with a pressure seal at its lower end and an inverted floating seal at its upper end. Magnetic and electrical means are provided to check for the presence and condition of the lubricant. To increase load capacity the spring means is made of a number of components acting in parallel.

36 Claims, 18 Drawing Figures

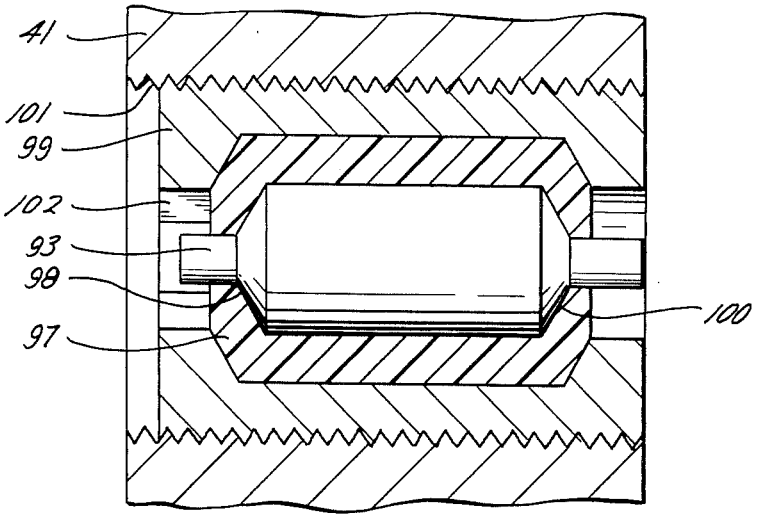
Fig. 1A
Fig. 5A
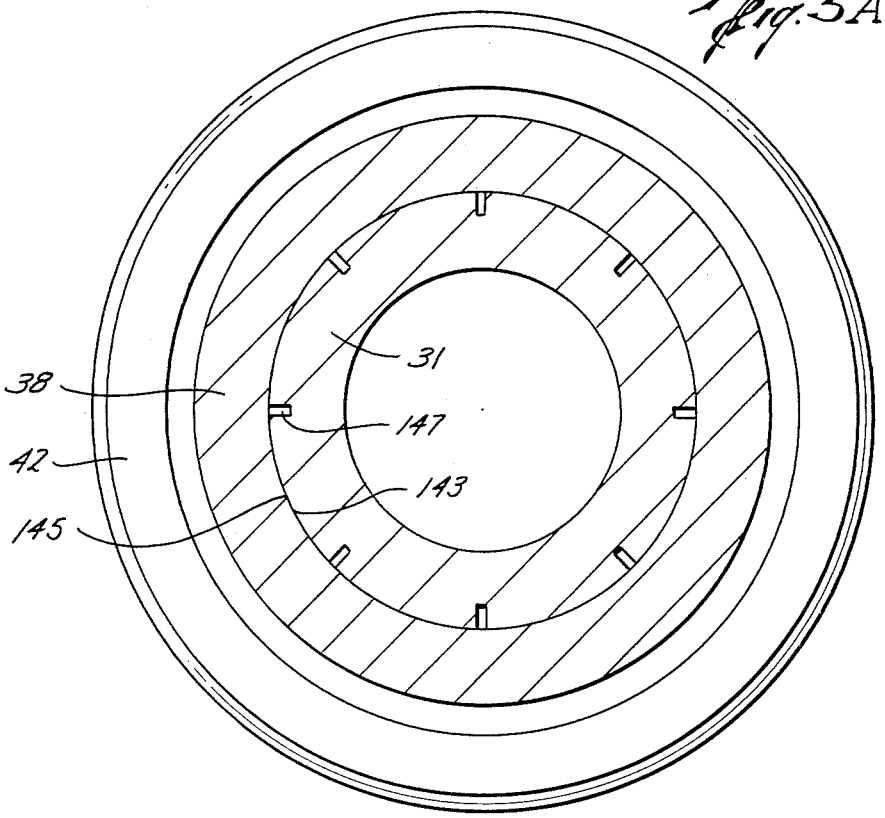

Fig. 2A"
41
68
121
31
105
103
101
99
97
93
91
71
69
61
60
70
52
53
62
63
54
55
87
73
56
57
72
64
51
65
82
76
83
85
59
74
58
66
67
77
81
79
208
68
DAMPER OPEN
210
DAMPER CLOSED 139
6
133
41
123
DAMPER OPEN
281
125
31
121
68
131
137
6
DAMPER CLOSED

Fig. 3A"
OPEN
CLOSED
167
162
42
33
177
151
209
189
284
175
282
143
147
145
38
31
5A
33
323
321
183
207
177
217
219
211
215
213
193
195
189
209
282
191
210
175
38
147
42
31
41
5A

Fig. 4A"
45
91
43
278
283
299
277
269
253
245
237
254
246
238
235
276
272
265
239
233
257
249
241
247
255
258
240
248
250
256
242
270
267
274
243
261
251
259
275
244
252
260
47
271
275
37
231
208
DAMPER OPEN
47
299
291
297
293
296
235
37
47
279
DAMPER CLOSED
35

Fig. 6
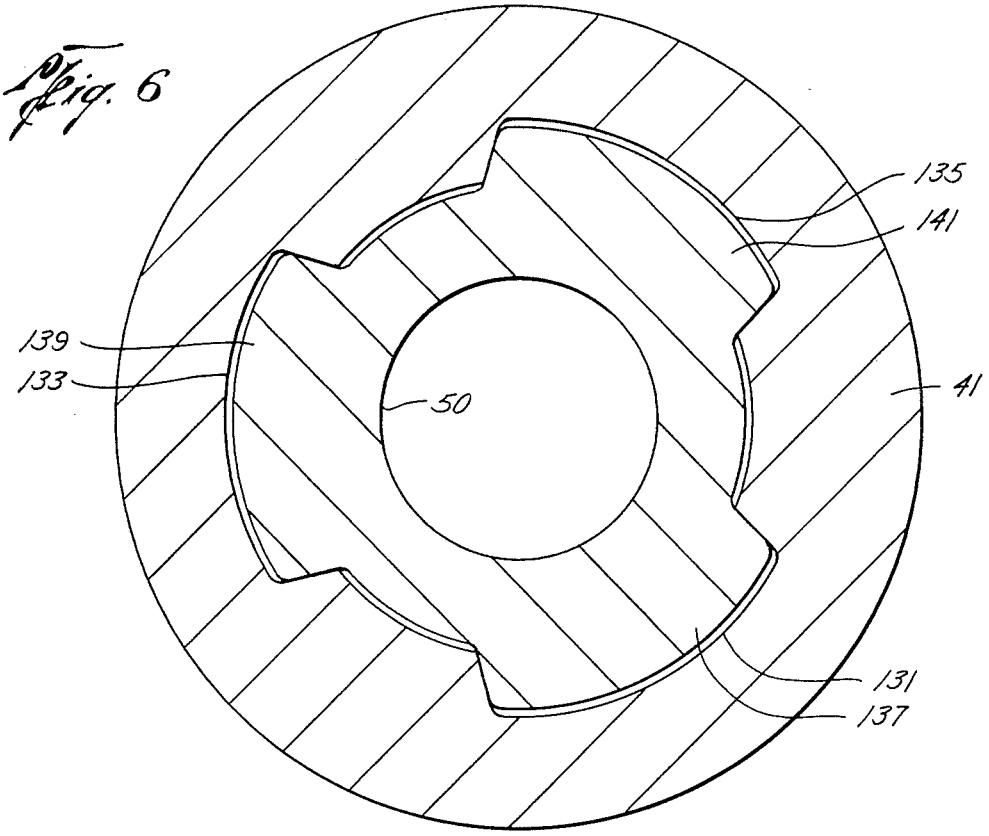
Fig. 4B'
Fig. 4B''
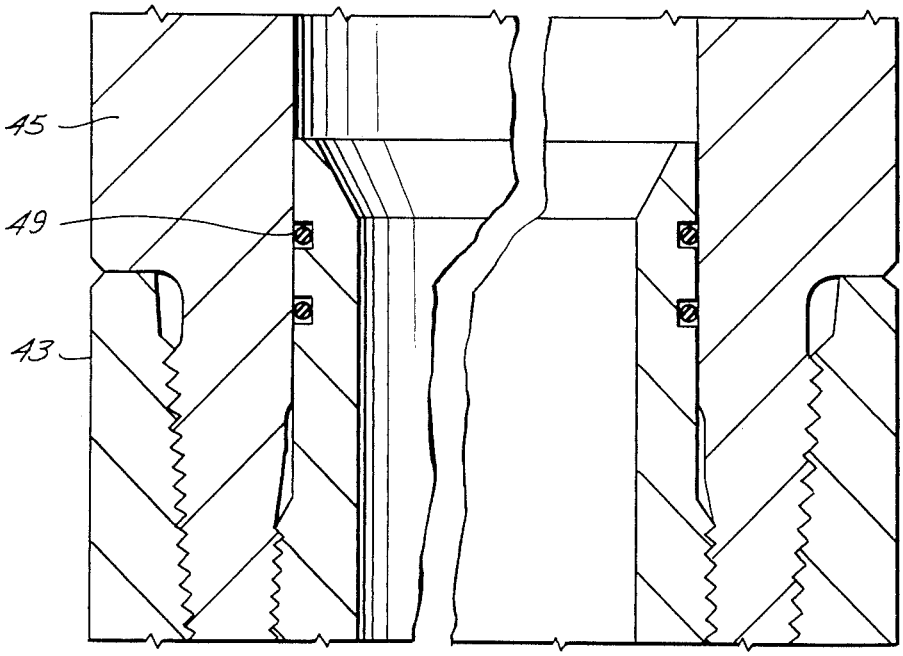

(A) LOAD VS DEFLECTION (X) SPRING RATE VS DEFLECTION

LOAD IN POUNDS

SPRING RATE IN POUNDS/INCH

DEFLECTION IN INCHES

| HOLE SIZE BITS | T.C. WEIGHT NORM. | T.C. WEIGHT MAX. | R.P.M. NORM. | R.P.M. MAX. | PUMP PRESSURE NORM. | PUMP PRESSURE MAX. |
|---|---|---|---|---|---|---|
| 9½-9⅞ | *30-50,000 | 60,000 | 45-60 | 90 | 1,000-1,400 | * 2,000 |
| 12¼ | 35-55,000 | ‡60,000 | 45-60 | 90 | ✓1,000-1,400 | 2,000 |

SEE BELOW CONDITION II

✓ AV. WT. 45,000 LBS. CONDITION I

‡ CONDITION III

✓ AV. WEIGHT ON BIT FORCE 45,000 LBS.

CONDITION I

✓ AV. PUMP APART FORCE 44,000 LBS.

AV. FLEXIBILITY FOR CONDITION I: NOMINAL DRILLING.

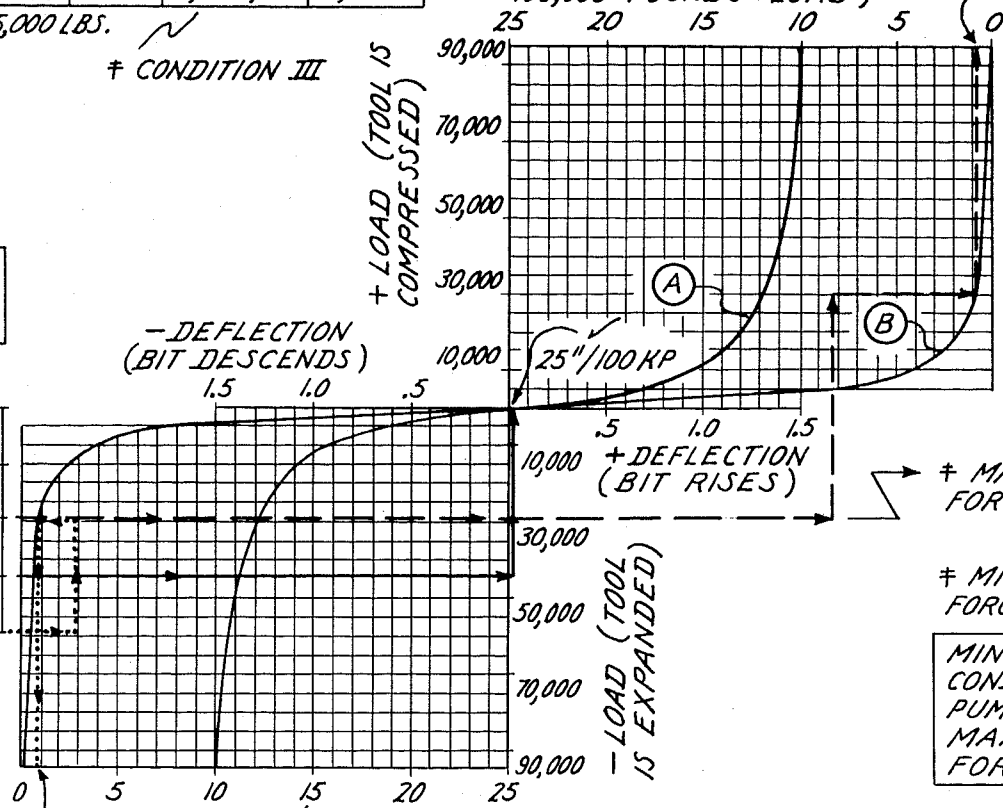

Fig. 9

‡ MAX. WEIGHT ON BIT FORCE 60,000 LBS.

CONDITION III

‡ MIN. PUMP APART FORCE 29,000 LBS.

MIN. FLEXIBILITY FOR CONDITION III: MIN. PUMP APART FORCE; MAX. WEIGHT ON BIT FORCE.

* MIN. WEIGHT ON BIT 30,000 LBS.

CONDITION II

* MAX. PUMP APART, 2,000 P.S.I. 59,000 LBS.

MIN. FLEXIBILITY FOR CONDITION II: MAX. PUMP PRESSURE; MIN. WEIGHT ON BIT FORCE.

CURVE (A) SHOWS SPRING FORCE AS A FUNCTION OF SPRING DEFLECTION

CURVE (B) SHOWS SPRING FORCE AS A FUNCTION OF DECREASING SPRING FLEXIBILITY IN INCHES PER 100,000 LBS.

DRILL STRING SPLINED RESILIENT TUBULAR TELESCOPIC JOINT FOR BALANCED LOAD DRILLING OF DEEP HOLES

BACKGROUND OF THE INVENTION a. Field of the Invention

This invention relates to earth boring tools, and more particularly to drill string resilient units useful in earth boring by the rotary system of drilling, such tools sometimes being called vibration dampers or shock absorbers, and relates specifically to a drill string splined resilient tubular telescopic joint.

b. Objects of the Invention

A principal object of the invention is to provide such a tool especially adapted for balanced load drilling, i.e. where the drilling weight and pump apart force are equal. Though the tool is specially intended for balanced load drilling, the tool may also be used with advantage under such other load conditions as may normally be expected and includes features of general utility in drill string resilient units.

Other objects and advantages of the invention will appear as the description thereof proceeds.

c. Description of Certain Prior Art

It appears that many prior art drill string resilient units have not been intended for use in balanced load drilling. For example, in U.S. Pat. No. 2,991,635—Warren, there is disclosed a tubular telescopic tool employing splines to transmit torque and multiple helical springs disposed in parallel to transmit axial force. Three sets of multiple sliding seals are employed, one above and one below the spline-spring means, and one separating the spline from the springs. The uppermost multiple seal includes upper and lower pairs of O-rings and a lubricating packing therebetween, with a grease fitting to allow injection of grease. However, the spring means come into action only upon contraction of the damper from the no load condition. Warren states that:

> "normally the springs 60 will be designed to be compressed substantially half way during a normal drilling operation. However, if a greater or lesser weight is desired on the drill bit 30, the drill string may be lowered or raised a short distance to increase or decrease the compression of the springs 60," (col. 5, lines 50–60).

In U.S. Pat. No. 3,949,150—Mason et al, there is disclosed a sealed, lubricated, splined, resilient, tubular telescopic joint for a drill string wherein contrary to the more usual arrangement the mandrel is connected to the drill string and the barrel or case is connected to the bit. A stack of rubber rings each sandwiched between flanged metal rings serves as a resilient element. Referring to the prior art it is said that due to hydrostatic pressure and the difference in area between the upper and lower seals of some dampers the resilient element is preloaded in compression, necessitating the use of "hard" deformable elements e.g. with an initial spring rate requiring 100,000 lb. for the first $\frac{3}{4}$ inch deflection and a later spring rate requiring another 100,000 lb. for the next $\frac{1}{4}$ inch deflection, but which will still go solid at normal drilling depths due to hydrostatic pressure. Other dampers are said to avoid this by using a floating seal for one end of the spring chamber, so as to equalize the pressure, but in such dampers Mason indicates that inappropriate springs were used.

Mason notes that for many shock absorbing elements the spring rate increases with the load causing the damper to operate at a point where the spring rate is high. Mason's objective is to provide a damper which operates at a position where the spring rate is low at all times. Mason therefore discloses a shock absorber having a low initial spring rate and having a floating seal to equalize pressure and eliminate preload. But since his spring means is only single acting, this requires operation about a mean position in which the spring means is partially compressed, so that the spring rate is higher.

Mason contemplates operating the damper with a static spring force of about 25,000 lb., at which point the damper has a spring rate of 20,000 lb. per inch. This static load on the spring is said to be the difference between 55,000 lb. drilling weight and a 30,000 lb. pump apart force. For operating in shallow wells where the bit weight may be low, to insure some static compression of the spring Mason proposes to reduce the pump apart force by reducing the area of the seal between mandrel and barrel. To that end he provides a lower seal ring of smaller area and vents the annulus between the lower seal ring and the floating seal ring.

Mason further notes (at col. 12, lines 21 et seq) that:

> "As may occur in some cases, the area enclosed by the outside diameter of the pressure seal ring times the differential pressure may be in excess of the load to be carried on the bit. In this case the damper would remain pumped open and would not function as intended."

To overcome this situation Mason eliminates the static pressure balancing floating seal and under-fills the spring chamber with lubricant so that the static pressure overcomes the pump apart force and compresses the spring enough for it to be operative.

In short, Mason et al disclose a single acting damper intended to operate about a partially compressed static load position thereby to avoid banging against the travel limit stops upon imposition of dynamic loads.

The Drilco Industrial division of Smith International, Inc. manufactures a vibration damper including telescoping members with a shoulder on the mandrel in between two shoulders on the barrel forming upper and lower pockets in which are disposed shaped rubber sleeves to provide variable spring rates. The upper sleeve is effective during normal operating conditions and the lower sleeve is effective when the bit is lightly loaded and the pump apart force exceeds the bit weight causing the damper to be extended rather than contracted in the static condition. The damper is intended especially for water well and other shallow hole drilling wherein the pump apart force is small. The lower sleeve is different from the upper sleeve, whose spring rate increases much less rapidly with deflection. Only one or the other of the rubber sleeves is strained at any one time. The spline-spring chamber is exposed to drilling fluid. This construction is shown in a brochure entitled:

> "Drilco Industrial SHOCK SUB ® Vibration Dampener" bearing the notation "0976 Printed in U.S.A."

and in

> U.S. Pat. No. 4,139,994 issued Feb 20, 1979 to George Abraitys Alther.

It is stated in the brochure:

> "Vertical shock is absorbed by a large elasomeric element in compression. The element material is specially compounded to provide optimum characteristics of load carrying ability, fatigue resistance, resilience and dampening. The element is geometrically shaped to provide uniform "softness" at bit weights from near zero to 30,000 lbs. A second, smaller elastomeric element is provided to cushion reverse loading during severe rebounds or when pulling from the hole."

SUMMARY OF THE INVENTION

According to the invention there is provided a splined resilient tubular telescopic joint especially adapted for drilling under balanced load conditions, i.e. where the drilling weight is substantially equal to the pump apart force. Under such conditions, the spring means is substantially unstressed when the joint is in neutral position, i.e. the position of the joint if the bit were rolling on a flat bottom hole. To provide the desired resilient action upon both rise and fall of the bit from such neutral position, a double acting resilient joint is provided, i.e. one which flexes both upon contraction and extension of the joint, and the resilient joint has a very low spring rate when the joint is in the neutral position and over a considerable range of deflection from the neutral position both upon extension and contraction of the resilient joint. Only as the joint approaches full extension or contraction does the spring rate increase to gradually, then rapidly, bring extension or contraction of the joint to a halt without banging the travel limit stops.

The resilient joint is provided with spring means which has like characteristics upon both extension and contraction of the joint. The spring means may comprise one or more pairs of oppositely directed like single action spring means, but preferably one or more double acting compression springs are employed wherein the same spring means is compressed whether the joint is extended or contracted. In either case, the spring means will have a variable spring rate, the spring rate being low over a wide range of deflection of the damper in both directions from the zero deflection condition and then increasing rapidly as the travel limit of the joint is approached, both upon extension and contraction of the damper.

For the spring means, stacks of springs, e.g. elastomer-metal sandwiches or Belleville springs, (conical washers), in series or series parallel disposition, are preferred, since it is easier to achieve the desired variable spring rate with such construction as compared, for example, to a helical sping. For support and protection the spring rings are disposed in an annular chamber between the telescoping members. To prevent binding, the rings are guided by only line contact with one of the telescoping members and are out of contact with the other member.

To reduce wear, the spring chamber, spline, and telescopic guide bearings are sealed from the drilling fluid and lubricated with oil. One end of the chamber is sealed by pressure seal means capable of withstanding the pressure differential between the interior and exterior of the joint. The other end of the chamber is sealed by a floating seal means which moves to a position in which there is no pressure differential across it. This not only allows for volume changes but leads to a balanced load on the spring means since the fluid pressure acting on the damper is therefore effective over the whole area within the pressure seal means.

Magnetic and electrical means are provided to check on the presence and condition of the lubricant and therefore the soundness of the seal means. The seal means both face downwardly to avoid trapping dirt; in other words the seal means are positioned so that the direction of flow, were any fluid to leak past the seal, would be upward.

EVOLUTION OF THE INVENTION

Applicant's conception of a damper especially adapted for balanced load drilling called broadly for a variable spring rate double acting damper, that is, one wherein low spring force resists both contraction and extension of the damper, and higher spring force is effective as the damper approaches its travel limits upon both contraction and extension of the damper.

Double Acting Dampers

Relative to double acting dampers broadly considered, the following United States patents and publications are noted.

U.S. Pat. No. 1,960,688—Archer (1934)
U.S. Pat. No. 2,325,132—Haushalter et al
U.S. Pat. No. 3,033,011—Garrett
U.S. Pat. No. 3,099,918—Garrett
U.S. Pat. No. 2,727,368—Morton (1955)
U.S. Pat. No. 3,122,902—Blair et al
U.S. Pat. No. 3,254,508—Garrett
U.S. Pat. No. 3,323,326—Vertson
U.S. Pat. No. 3,447,340—Garrett (1969)
U.S. Pat. No. 3,503,224—Davidescu
U.S. Pat. No. 3,779,040—Garrett
"Cougar Shock Tool"—Cougar Tool Co. Ltd.—ante c. 1977.

In the foregoing constructions, though the joint is flexible both upon extension and contraction, note needs to made of the positions of the travel limit means, a greater travel in contraction indicating a joint intended to operate with the spring means in compression in the neutral position. For further consideration, the above listed patents are divided into four groups according to the nature of the spring means, as follows:

a. Shear Type

In the Archer patent there is disclosed a telescopic drill string damper in which a rubber sleeve between the telescoping members apparently is loaded in shear, allowing the rubber to be stressed whether the damper is extended or contracted. A similar construction is shown in the Haushalter et al patent. Neither of these constructions requires a spline, torque being transmitted through the rubber.

Garrett Pat. No. 3,033,011 shows a vibration damper employing a telescopic joint and an elastomeric axial resilient element which also transmits torque, travel limit stops, guides to take bending moment, and a sliding seal. The damper is double acting in that both extension and contraction place the resilient element in shear. A similar construction adding an emergency clutch to transmit torque in case of failure of the rubber sleeve is shown in Garrett's U.S. Pat. No. 3,099,918.

In the Davidescu patent there is shown a damper employing sleeve type rubber metal sandwiches between the mandrel and barrel. It appears that both extension and contraction of the damper will place the resilient elements in shear.

In Garrett U.S. Pat. No. 3,779,040 there is disclosed a vibration damper to be used between the drill steel and power swivel of a boring machine, employing an elastomer resilient unit.

All of the foregoing shear type dampers would appear to have fairly constant spring rates.

b. Alternate Tension-Compression Type

Applicant's U.S. Pat. No. 3,254,508 relates to a bellows type vibration damper, the bellows serving to transmit torque, axial force and fluid and being surrounded by a sealed chamber in which is disposed a lubricant separated from the drilling fluid by the bellows and a floating seal. The damper bellows is compressed upon contraction of the joint and placed in tension when the damper is extended.

In applicant's U.S. Pat. No. 3,447,340 there is disclosed a damper similar to that of the aforementioned Garrett U.S. Pat. No. 3,254,508 except that the bellows has helical convolutions. The travel limit stops are positioned so that the damper can both extend and contract, tensioning or compressing the spring, but the permissible extension travel is much less than the contraction allowed.

Although a single spring means is employed in the double acting dampers of the above two patents, the spring action is different upon extension than it is upon contraction of the damper, and in both cases the initial spring rate at zero deflection is apparently of the same order of magnitude as at the travel limits.

c. Differently Positioned Springs Alternately Compressed

In the Morton patent there is disclosed a vibration damper to be used in propeller shafts. The damper comprises telescoping members with a rubber sleeve in the annulus therebetween and bonded thereto to transmit torque. Shoulders on the members engage the rubber sleeve axially so as to transmit thrust. The arrangement appears to be such as to axially compress one part of the rubber sleeve upon thrust in one direction corresponding to contraction of the damper and to axially compress another part of the rubber sleeve upon extension of the damper (e.g. during reversal of the propeller), and it appears that tension is alternately applied to such parts of the rubber sleeve as are not compressed. It is further stated that due to the differing axial thicknesses of the sleeve there will be two natural periods of torsional vibration so that torsional vibrations will tend to interfere and cancel out.

In the Vertson patent there is disclosed a telescopic damper including helical shoulders on the barrel and mandrel with two joined helical rubber elements therebetween. Apparently one element is compressed while the other is unloaded, causing rubber to flow from one element to the other, regardless of whether the damper is extended or contracted.

The Cougar leaflet appears to disclose a telescopic tool employing two rubber sleeves as resilient elements, which may act alternately upon extension and contraction of the joint or may merely functon as in U.S. Pat. No. 3,660,990—Zerb, wherein it is said that a rubber seal in series with the main resilient sleeve also acts to damp shocks.

It does not appear that any of the rubber elements of the constructions of the foregoing group of patents is designed to have a variable spring rate with an extremely low spring rate over a range of deflection in both directions coupled with a very high spring rate at both travel limits.

Variable Spring Rate Dampers

Applicant's first conception of a variable spring rate resilient unit for balanced load drilling contemplated the possible use of felted steel wire ("steelwool") annular pads for the spring elements, such elements filling the annular chamber between mandrel and case and engaging the side walls thereof. Somewhat similar elements are shown in U.S. Pat. No. 3,383,126—Salvatori et al, 3,406,537—Falkner, Jr. Salvatori et al shows a vibration damper employing an upper sliding lip seal and a lower floating seal, with a spline and a resilient element in the chamber therebetween. A similar construction is shown in the Falkner, Jr. patent. Falkner, Jr. fills his chamber with oil.

Double Acting Dampers With Single Spring

When applicant first conceived of his invention of a variable spring rate double acting damper for balanced load drilling, he requested one of the engineers in his department to draw up an embodiment. The engineer chose as spring means for the double acting damper, a double acting compression spring construction, thereby to compress the same stack of wire pads upon both extension and contraction of the damper. The wire pads were disposed between shoulders on the barrel and mandrel, with spacers allowing the shoulders to lie in different planes. Such a double acting spring construction is employed in the preferred embodiment of the double acting damper shown herein. Relevant to such construction are the following publications:

U.S. Pat. No. 3,381,780—Stachowiak (1968)

U.S. Pat. No. 2,372,214—Loepseinger (1945)

U.S.S.R. inventor's certificate No. 1,279,335—Shprenk (1970), all three of which apparently show such shoulder disposition, and Shprenk appearing to show such spacers.

The Stachowiak patent relates to a formation testing shock absorber. The shock absorbing element includes an elastomer sleeve axially compressible and radially expansible to pump a liquid out of dash-pot space. A solid floating piston for pressure and volume compensation is employed. The damper is double acting, the mandrel and barrel members each having two axially spaced apart shoulders which extend less than half way across the annulus between the members, so that the rubber sleeve captured in the annulus between the shoulders is compressed axially upon both extension and contraction of the joint. The resiliency of the sleeve is said to return the sleeve to full extended shape and the tool to neutral position. When the elastomer sleeve is compressed, it rubs on the surrounding case. Though the sleeve is shaped, the effect is said to cause increasing friction as deflection increases, without mention of any spring action. At the same time, the deformation of the sleeve constricts the dash pot action. A constant force versus deflection is said to be achieved. This corresponds to a constant spring rate of zero.

The Shprenk et al publcation, entitled "Superbit Shock Absorber", appears to disclose a vibration damper employing barrel and mandrel members with elastic rings gripped in parallel between the members and engageable by axially spaced shoulder means on the mandrel and also by axially spaced shoulder means on the barrel, to strain the elastic elements whether the damper is extended or contracted, spacers allowing the shoulders to be non-coplanar. However, the elastic elements are strained, apparently, by relative axial movement of their inner and outer peripheries relative to a bridging washer embedded in the elastic elements rather than by axial approach of their end faces.

In neither the Stachowiak nor the Shprenk publications is there any discussion of the pump apart force nor balanced load drilling nor any disclosure of using a plurality of rings in series to achieve high flexibility, nor paralleled groups of series stacked rings to reduce stress on individual rings.

Rubber Sandwich Springs

In the evolution of his invention, applicant later conceived of a spring means including a plurality of elastomer rings of oval cross-section sandwiched between dished metal washers. A search relative to this type of spring revealed certain prior United States patents as follows:

U.S. Pat. No. 2,733,915—Dentler (1956)
U.S. Pat. No. 2,930,491—Cook (1960)
U.S. Pat. No. 2,946,462—Danielson (1960)
U.S. Pat No. 2,982,536—Kordes (1961)
U.S. Pat. No. 3,330,519—Thorn (1967)
U.S. Pat. No. 3,480,268—Fishbaugh (1969)
U.S. Pat. No. 3,493,221—Mozdzanowski (1970)
U.S. Pat. No. 3,677,535—Beck (1972)
U.S. Pat. No. 3,814,411—Aarons et al (1974)
U.S. Pat. No. 3,997,151—Leingang (1976)

Applicant has since conceived of an improved spring means of this type providing for paralleling several groups of such rubber sandwiches, as will be described in more detail hereinafter.

Other drill string resilient units employing rubber sandwich spring means are known. For example, there is disclosed in British Pat. No. Br. 220,470 (1924)—Reichwald, a telescopic jar with torque transmissin means, useful for well drilling, wherein the jar is cushioned on the lifting or jar extension stroke by a plurality of rubber rings sandwiched between flanged metal rings. The flanges, normally out of contact, limit compression of the rubber. The rubber rings are spaced radially from both the inner and outer telescopic members and the flanges of the metal rings surround the inner member.

A tubular telescopic joint employing a spline, sliding seal, and resilient means, to form a vibration damper is shown by U.S. Pat. No. 3,301,009—Coulter, Jr. (1967). In the Coulter construction the resilient means includes a plurality of hexagon cross-section elastomer rings with single flat washers interposed between each adjacent pair of elastomer rings. The resilient means is single acting. The sides of the rings rub against the mandrel of the telescopic joint. A form of inverted sliding pressure seal is shown at the upper end of the spring chamber, but the spring chamber is not sealed at its lower end.

Belleville Springs

In the further evolution of his invention of a resilient unit for balanced load drilling, applicant considered the employment of Belleville springs disposed in series-parallel stacks. At this stage, applicant was particularly concerned with protecting the seals employed for the lubricated chamber in which the springs are mounted.

The use of plural telescopic joints, one for each leg of a three cone roller bit is shown in U.S. Pat. No. 2,815,928—Bodine, the joints each including a vibration damper in the form (FIG. 6) of a stack of dished washers alternately disposed. Axially spaced cylindrical bushings provide vertical motion supports. Interengaging means on the bit legs and bit body limit relative rotation. In a modification (FIG. 9), a single spline telescopic joint is used and the resilient member is in the form of a long steel sleeve. The spline is in a sealed chamber filled with grease; the seals for the chamber are sliding seals. The steel sleeve is also sealed at both ends and extends above and below the spline. Volume compensating ports at one end expose the upper spline seal to well fluid and the lower spline seal is exposed thereto at the lower end of the tube.

In U.S. Pat. No. 3,539,026—Sutliff et al, is disclosed a fishing tool energizer comprising a splined telescopic joint with groups of paralleled Belleville springs stacked in series to provide the resilient unit. To vary the spring force, more or fewer springs can be parallel in each group.

A vibration damper employing Belleville springs for the resilient element is shown in U.S. Pat. No. 3,871,193—Young. The resilient element and spline are in a lubricating oil chamber formed by upper and lower sliding seals between telescoping inner and outer members. The resilient element includes a plurality of spring means of different spring rates stacked in series. When the lighter spring means reach their limit of travel, the heavier spring means are left, presenting a higher spring rate. In two embodiments, groups of Belleville springs are employed stacked in series with varying members of springs paralleled in each group. In another embodiment coil springs of differing cross-sections are stacked in series.

U.S. Pat. No. 3,898,815—Young, discloses a sealed, lubricated telescopic tool including ball spline means and disc spring means.

A shock absorber for well drilling pipe is shown in U.S. Pat. No. 4,133,516—Jurgens. The Jurgens tool incorporates two paralleled groups of series stacks of paralleled subgroups of Belleville springs. The springs are in lubricant filled pockets defined by upper sliding seals and lower equalizer pistons. Restriction means is provided to retard the flow of lubricant as the pockets expand and contract during drilling, thereby creating hydraulic damping due to throttling of the fluid flow. The hydraulic damping adds to the damping effected by the friction between the springs in each sub group.

A vibration damper made in Canada by Smith International Canada, includes a telescopic joint, spline, a stack of several groups of Belleville spring with the groups in series and the springs in parallel in each group, seals above and below the spline providing a chamber for lubricant, a three inch travel from no load to 60,000 lb. and a spring rate of 20,000 lb/inch.

None of the above constructions appears to be concerned with balanced load drilling.

Most recently, applicant asked J. B. Hiebel, one of the men in his department, to further the development of his invention of a double acting damper for balanced load drilling. This further development resulted in a damper construction employing roller Belleville springs, shown as the preferred embodiment of applicant's damper for balanced load drilling. A separate application by J. B. Hebel, Ser. No. 38,790, filed contemporaneously herewith, discloses on a damper employing roller Belleville springs.

Roller Belleville springs are a species of variable moment Belleville springs, the latter being disclosed in U.S. Pat. No. 2,675,225—Migny. In FIG. 3, it is shown that such springs may be stacked in series-parallel, but the parallel springs are not all of the variable moment type, including simple dished washers in the middle of each parallel group.

SEALED LUBRICATED SPRING-SPLINE-BEARING CHAMBER

As noted previously, part of applicant's overall concept of a damper for balanced load drilling included a sealed and lubricated spring-spline-bearing chamber. In addition to the patents previously discussed, a number of other patents may be mentioned relative to the employment of a sealed lubricated spring-spline-bearing chamber, in a tubular, axially resilient telescopic joint for well drilling, as follows:

U.S. Pat. No. 2,025,100—Gill et al
U.S. Pat. No. 2,240,519—Reed (three lobed spline)
U.S. Pat. No. 3,323,327—Leathers et al
U.S. Pat. No. 3,345,832—Bottoms
U.S. Pat. No. 3,581,834—Kellner and Garrett

BRIEF DESCRIPTION OF THE DRAWINGS

For a description of a preferred embodiment of the invention, reference will now be made to the accompanying scale drawings, the elevational and cross-sectional views showing that the parts are made of metal, e.g. steel, except as otherwise indicated, e.g. the seals are preferably made of Teflon or an oil and water resistant elastomeric material, and in a modification elastomer-metal sandwich spring elements are employed.

FIG. 1A is a detail to a larger scale, showing the electrical test probe of the damper;

FIGS. 2A'' and 2B'' together hereinafter referred to as FIG. 2'', are fragmentary sectional views similar to FIG. 2' showing the lower end of the damper in the closed or contracted position;

FIGS. 2' and 2'' are drawn with a common center line for easy comparison and may be referred to together as FIG. 2;

FIGS. 3A'', 3B'' and 3C'', together hereinafter referred to as FIG. 3'', are fragmentary sectional views, similar to FIG. 3', showing the medial portion of the damper in the closed or contracted position.

FIGS. 33' and 3'' are drawn with a common center line for easy comparison, and these figures taken together may be hereinafter referred to as FIG. 3;

FIGS. 4A'' and 4B'', together hereinafter referred to as FIG. 4'', are views similar to FIGS. 4A' and 4B', showing the upper end of the damper in the closed or contracted position;

FIGS. 4' and 4'' are drawn with a common center line for easy comparison and may be referred to together as FIG. 4;

FIGS. 5, 5A and 6 are respectively sections taken at planes 5—5, 5A—5A and 6—6 of FIGS. 3 and 2';

FIGS. 8, 9 and 9A are graphs; and

DESCRIPTION OF PREFERRED EMBODIMENTS

Damper

Figure 1:
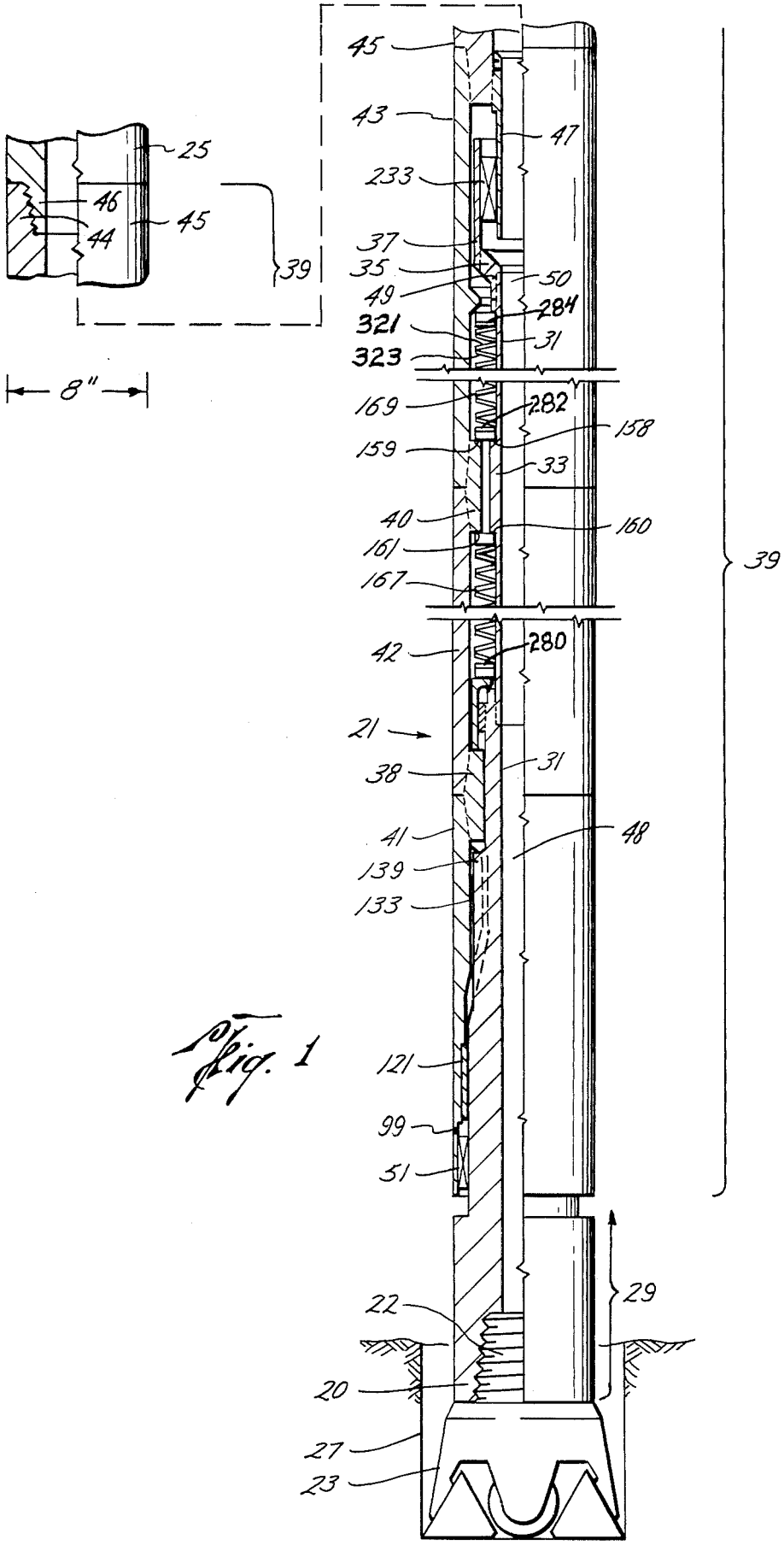
FIG. 1 is an elevation, partly in section, showing a damper according to the invention assembled in the lower end of a drill string, with the spring means in the neutral or unloaded position.

Referring now to the drawings and in particular to FIG. 1, there is shown a damper 21 connected at its lower end to a three cone drill bit 23 and at its upper end to another lower drill string member 25 such as a stabilizer or drill collar. Although the drawing shows the damper directly above the bit, it may be employed at other places in the drill string, preferably however where most of the weight slacked off in the drill string is above the damper. The apparatus is shown in a well bore 27 being drilled by bit 23 by the rotary system of drilling. The damper includes a tubular mandrel identified generally by reference number 29. The mandrel comprises a lower seal and bearing and spline portion 31, a medial spring portion 33, a cross over sub portion 35, and an upper compensator portion 37. Mandrel portions 31, 33, and 35 are connected by rotary shouldered taper threaded connections, such connections being more fully described in U.S. Pat. No. 3,754,609—Garrett. Mandrel portion 37 is shrink fitted to mandrel portion 35.

Mandrel 29 works telescopically within and about a tubular barrel indicated generally by reference character 39. The barrel includes a lower seal and bearing and spline portion 41, a medial spring portion 43, an upper cross over sub 45, and a depending compensator portion 47. Barrel portions 41, 43, 45 are connected together by rotary shouldered connections as above referenced. Barrel portions 45, 47 are connected together by a taper thread and are sealed by an 0 ring 49.

The connections between the damper and drill bit and between damper and the upper part of the drill string are also rotary shouldered connections. Such connections each comprise a pin and box connector and either type of connector may be provided at each end of the damper, depending on what type of use is to be made of the damper. As shown, a box connector 40 is provided at the lower end of the damper for connection with a drill bit pin 42, and at the upper end of the damper there is a box connector 44 for connection with a pin 46 on lower drill string member 25.

Passage means through the damper for conveying drilling fluid from lower drill string member 25 to drill bit 23 include central passages 48, 50 through tubular mandrel portions 31, 33.

Figure 2A:
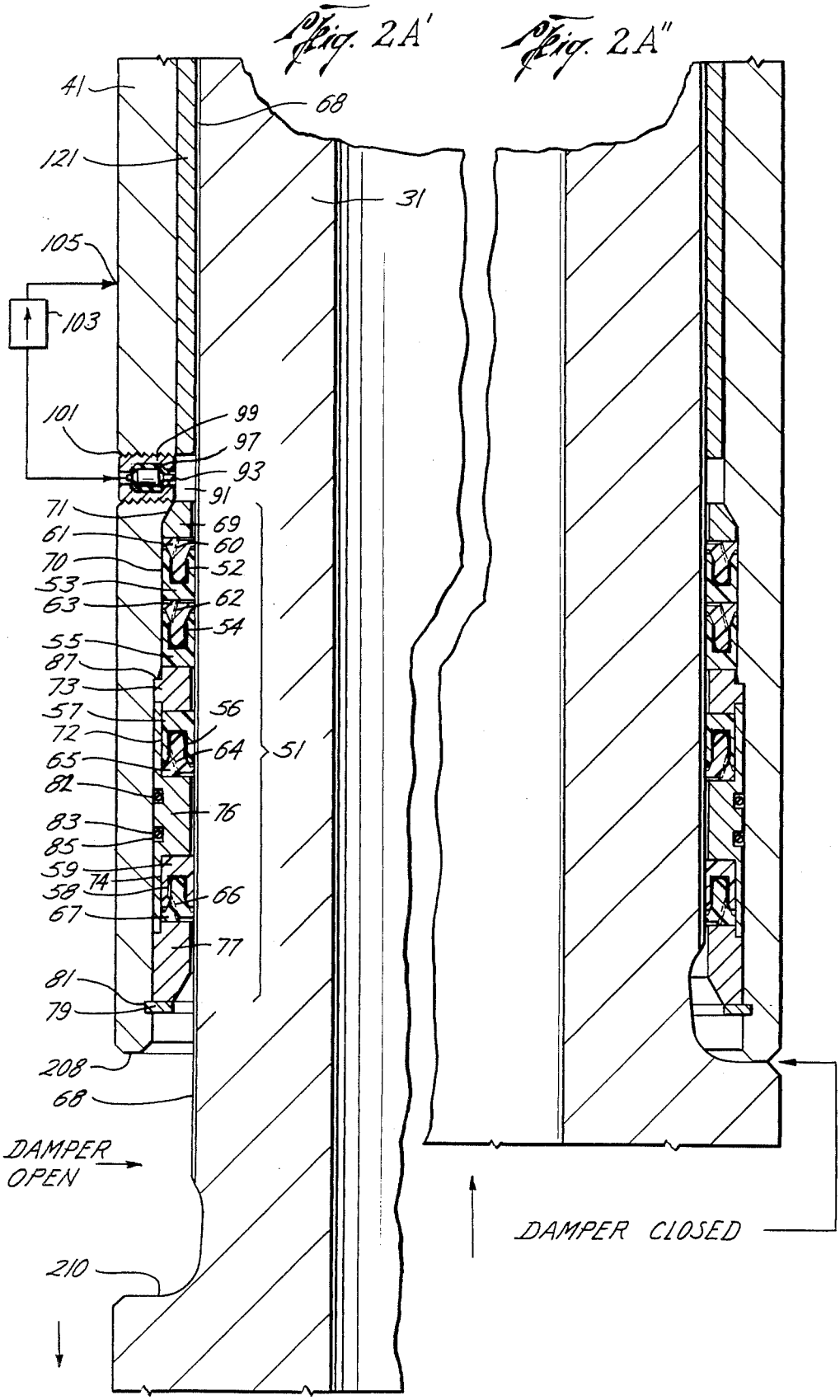
FIGS. 2A and 2B, together hereinafter referred to as FIG. 2', are fragmentary sectional views to a larger scale showing the pressure seal, bearing and spline at the lower end of the damper, with the damper in the open or extended position.
Figure 2B:
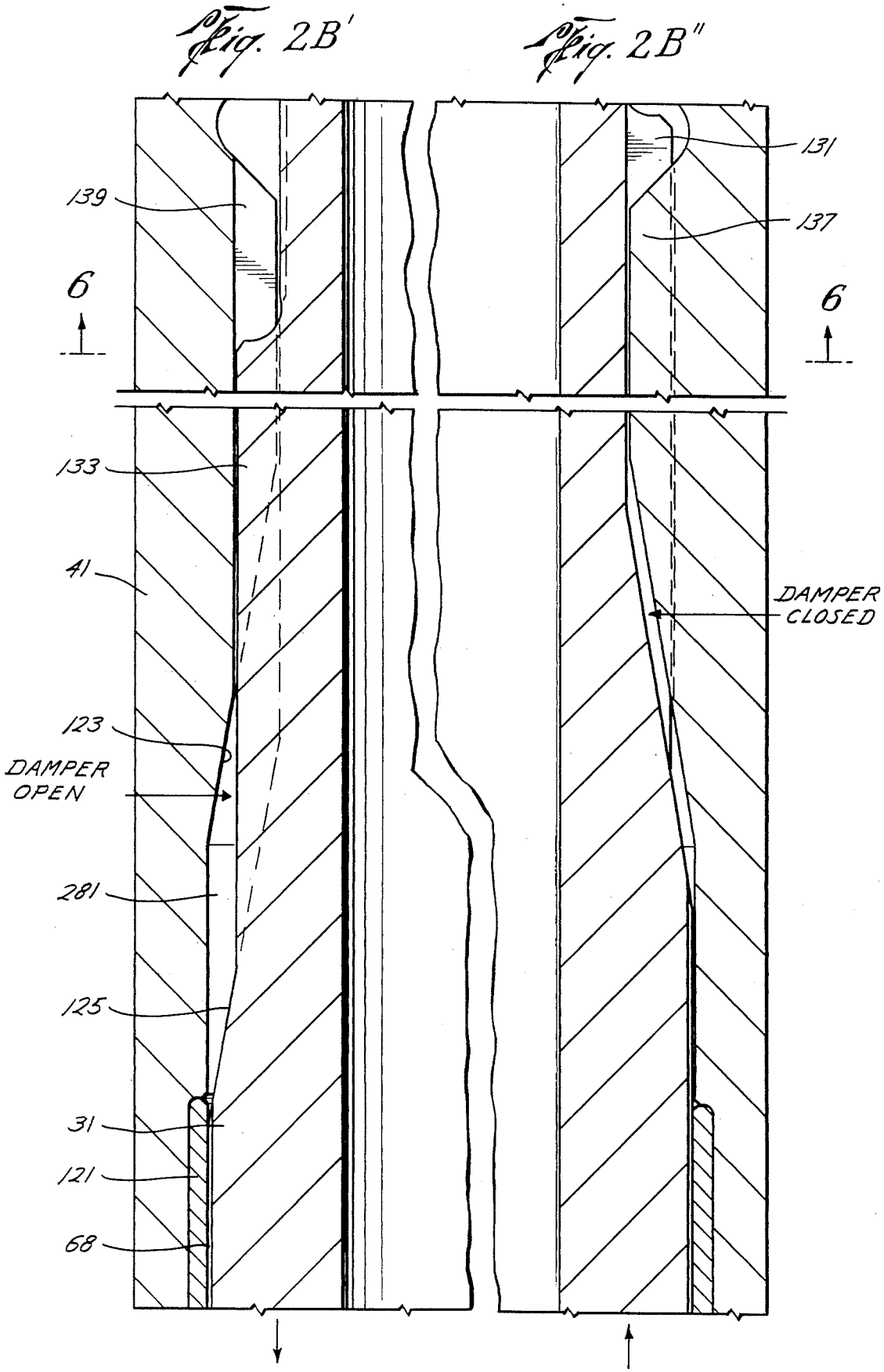

Referring now to FIG. 2, there is shown most of the lower portion of the damper, forming the seal, bearing and spline part thereof. This includes portions 31, 41 of the mandrel and barrel.

Pressure Seal

At the lowermost part of the damper there is seal means 51 disposed between the barrel and mandrel portions 31, 44. Seal means 51 comprises a plurality of double lip seal rings 53, 55, 57, 59. Seal rings 53, 55 face upwardly; seal rings 57, 59 face downwardly. The seal rings are preferably made of Teflon or other low friction coefficient, high temperature resistant, flexible, resilient, sealing material. The lips of the seal rings are preloaded to move away from each other by corrosion resistant metal springs such as those indicated at 52, 54, 56, 58.

Metal wedge rings 61, 63, 65, 67 also hold apart the lips of the seal rings to assist them in moving into sealing engagement with low friction coefficient hard metal finished surface 68 at the cylindrical outer periphery of mandrel portion 31 and the finished surfaces 70, 72, 74 at the cylindrical inner periphery of barrel portion 41 and the cylindrical upper and lower inner peripheral portions of spacer ring 76. Weep holes 60, 63, 64, 66 equalize fluid pressure on opposite sides of the rings. The wedge rings have tongues extending to the bottoms of the annular spaces between the seal ring lips to transmit force through the bottoms of the seal rings when axial force is imposed on the wedge rings. Although as noted above, the wedge rings spread apart the lips of the seal rings, their function of transmitting force through the bottoms of the rings being their primary function, thus permitting stacking of the seal rings, as in the case of rings 53, 55. In addition, the flat surface of the uppermost wedge ring 61 facilitates retention of the seal rings in the barrel underneath steel retainer ring 69. Ring 69 is beveled and rests against bevel shoulder 71 in the barrel.

The force of the fluid pressure in the damper acting down on seal rings 53, 55 is transferred by end ring 73 through support ring 76 to end ring 77 and thence to snap ring 79, received in annular groove 81 in the lower end of the barrel.

Support ring 76 is sealed to the barrel by O rings 82, 83 received in annular groove around the support ring. The O rings are in slight compression between the bottoms of the grooves and barrel surface 85. Support ring 76 is held fixed in the barrel between end rings 73, 77, which are captured between snap ring 79 and a shoulder 87 at the juncture of upper seal surface 70 and larger diameter lower seal surface 85. Therefore O rings are suitable for the non-sliding seal between the barrel and support ring 76. This is in contrast to the seals effected by seal rings 53, 55, 57, 59 with the mandrel, which are axially sliding seals.

Support ring 76 not only transfers load from the upper seal rings to snap ring 81 but also provides a cartridge independently supporting seal rings 53, 55 so that load is not transferred from one through the other as in the case of the uppermost seal rings 53, 55, thereby insuring that the lip seal action of each ring remains unimpaired. A similar cartridge construction could be used for the upper two seal rings if desired. Or if preferred, the lower seal rings 57, 59 could be stacked with only a wedge ring in between as in the case of the upper seal rings.

The lower seal rings 57, 59 seal primarily against upwardly directed fluid pressure from the fluid outside the damper. The force of the pressure is transferred to shoulder 87 through end ring 73 in the case of seal 57 and through support ring 76 and end ring 73 in the case of seal ring 59. No force of pressure fluid is intended to be transferred from end ring 77 to wedge ring 66, nor from support ring 76 to wedge ring 65.

Test Probe

As will appear more clearly hereinafter, although seal means 51 seals against the pressure of fluid both in the well bore outside the damper and in the drill string connected to the damper, seal means 51 is exposed to drilling fluid only on its lower side. Above seal means 51 in the space between the barrel and mandrel there is a clean lubricating oil 91 extending all the way up to the compensator portions of the barrel and mandrel. Within this clean fluid work the spline and resilient means later to be described. It is important for the user to know if any of the damper seals has failed. If such failure causes an influx of drilling fluid, the lubricating fluid will become contaminated by the drilling fluid, e.g. with water.

Referring now particularly to FIGS. 1, 1A, and 2A', to detect such a change there is provided in the barrel just above lower seal means 51 a test probe comprising an electrically conductive (metal e.g. brass) electrode 93 extending through the barrel wall. The electrode is surrounded on its outer periphery by and bonded and sealed to electrically insulating sleeve 97 which in turn is mounted in and bonded and sealed to screw plug 99 which is the closure for a lubricant injection and drainage port provided by threaded hole 101 in the barrel wall. The plug is screwed into the port. To prevent the electrode from moving axially under the pressure differential between the interior and exterior of the barrel, the electrode is made of larger diameter at its mid portion than at its ends, leaving tapered shoulders 98, 100 adjacent each end. An annular recess in the screw plug is shaped correlative to the exterior of the electrode forming shoulders at each and of the recess facing toward the shoulders on the electrode. The insulation sleeve is captured at each end between the plug and electrode shoulders and resists relative motion of the electrode and plug. The outer diameter of the mid portion of the electrode is too big to pass through the recess in the plug at the outer end thereof. A material suitable for the insulation sleeve is one which can withstand pressure differential and well fluids such as a plastics material, e.g. epoxy. At its outer end, the recess in plug 99 is formed as a wrench socket 102 to facilitate assembly and disassembly.

By connecting an ohmmeter 103 between the outer end of the electrode and a point such as 105 on the exterior of the barrel, the electrical resistance of the oil 91 can be measured to determine its character, i.e. whether or not it has become contaminated. If so, the damper seals and lubricant need to be checked for replacement and then replaced to the extent required.

It may be noted that whereas the lubricating oil has a high resistivity, most drilling fluids have a low resistivity. Furthermore, the drilling fluid will usually be denser than the oil and will sink to the bottom of the space normally occupied by the oil. That is why the test probe is placed at the lowermost part of such space, just above lower seal means 51. At that point, the test probe will contact any such drilling fluid and the resistance test will show a low resistance path through such drilling fluid.

Lower Bearing Means

Still referring to FIG. 2, above plug 99, the interior of barrel portion 41 is provided with a replaceable bushing or linear 121 made of a wear resisting, low friction coefficient, corrosion resistant bearing material compatible with hard facing material 68 on mandrel 31. For example, linear 121 may be made of beryllium copper or aluminum bronze or the equivalent. The bushing has a smooth cylindrical inner surface which cooperates with a continuation of surface 68 on the exterior of the mandrel to provide bearing means. The bearing means transmits bending moment between mandrel and barrel while providing for relative axial motion therebetween. To provide maximum area for taking bending moment, flutes 147 are made deeper than they are wide.

Spline

Above the bearing means just described, the wall of barrel portion 41 thickens by a reduction in its inner diameter, and there is a correlative thinning of the wall of mandrel portion 31 by a reduction in its outer diameter. Conical surfaces 123, 125 are formed where these transitions occur.

Referring now also to FIG. 6, the interior of the thick walled part of barrel portion 41 is fluted parallel to the barrel axis, forming three vertical grooves 131, 133, 135. The mandrel at this level is provided with three splines 137, 139, 141 which fit into the grooves and cooperate therewith to provide spline means for transmitting torque between the barrel and mandrel while providing for relative axial motion. While a spline can be made to transmit bending moment, e.g. by having the spline bottom in the grooves, the spline means here disclosed is intended primarily for transmission of torque through the side walls of the splines and grooves, the walls having large radial components. However some transmission of bending moment will also be provided by the spline means due to the circumferential components of the side walls of the splines and grooves. Each spline side wall may, for example, make an angle of e.g. 15° to 45° with the radial plane therethrough, FIG. 6 showing a representative desirable angle.

Upper Bearing Means

Above the spline, just described, the inner periphery 143 of buried pin 38 is in sliding contact with the outer periphery 145 of mandrel portion 31, thus providing an upper guide bearing. The upper and lower guide bearings, being spaced apart axially, can take considerable bending moment without being overloaded. The outer periphery of mandrel 31 is fluted at 147, providing fluid passages for lubricating oil 91, as will be explained in more detail hereinafter.

Resilient Means

Figure 3A:
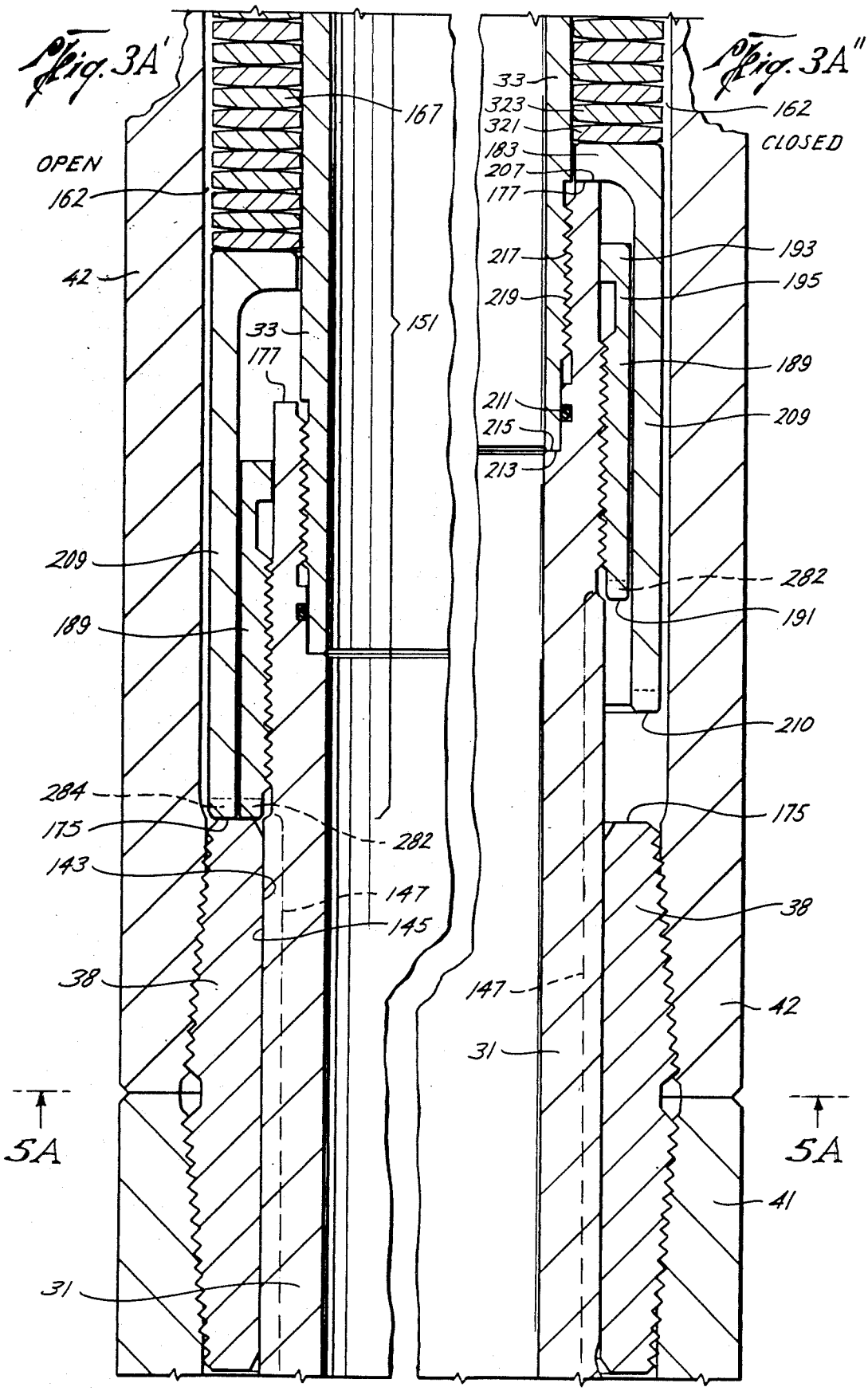
FIGS. 3A', 3B' and 3C', together hereinafter referred to as FIG. 3', are fragmentary sectional views, also to a larger scale than FIG. 1, showing the resilient unit at the medial portion of the damper in its open or extended position.
Figure 3B:
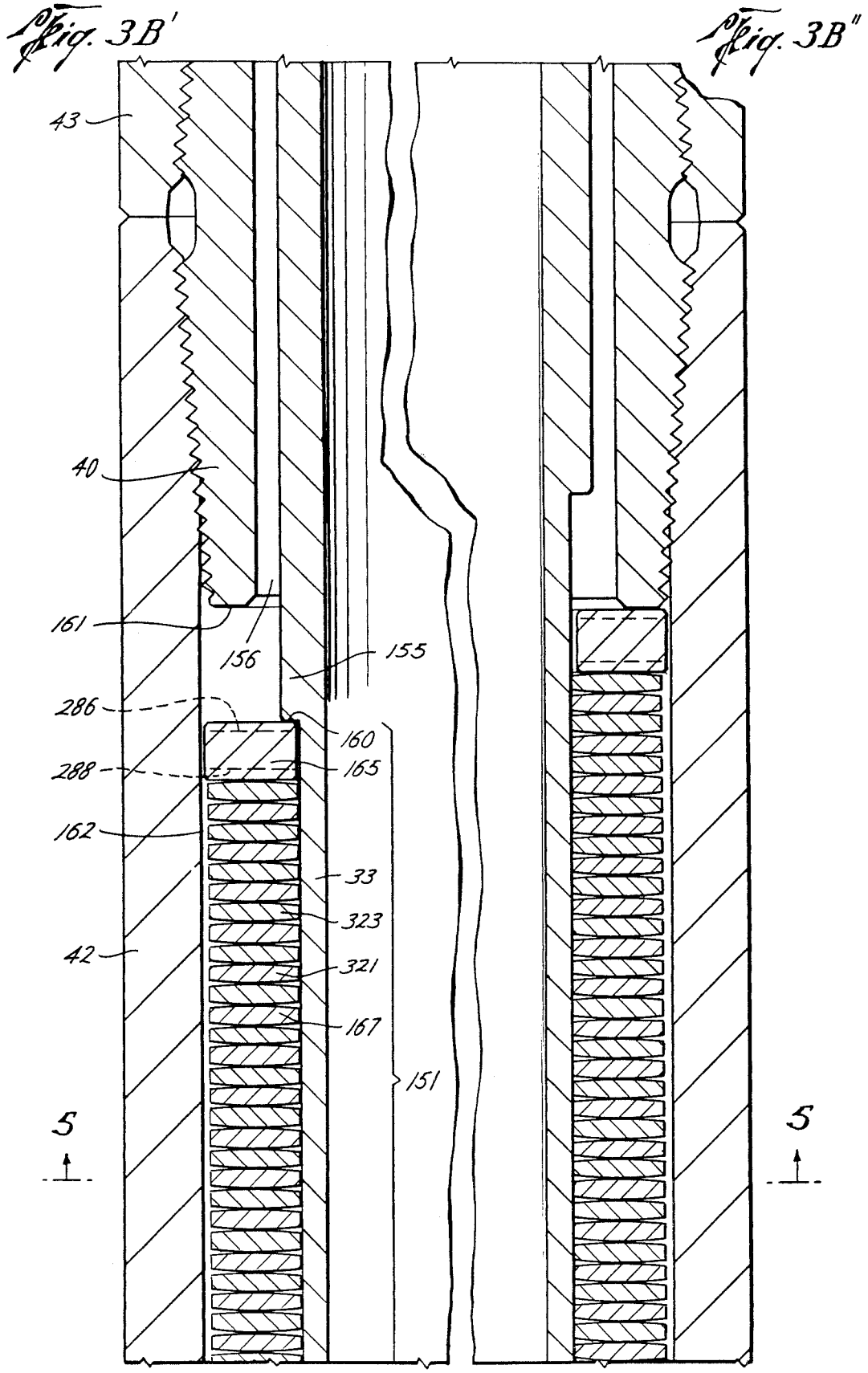

Referring now to FIG. 3, there is shown the medial portion of the damper including the resilient means thereof comprising mandrel portion 33 and barrel portions 42, 43 with spring means 151, 153 therebetween. Mandrel portion 33 has an outturned flange 155 (FIG. 3B', 3C') therearound, and buried pin 40 between barrel portions 42, 43 forms in effect an inturned flange within the barrel. These flanges provide upwardly facing annular shoulders 158, 159 and downwardly facing annular shoulders 160, 161. These shoulders define the inner ends of annular pockets 162, 163 between mandrel portion 33 and barrel portions 42, 43. At the inner ends of these pockets are pressure rings 164, 165 engaged respectively with the ends of spring stacks 167, 169 and engageable with shoulders 158–161.

The upper end of pocket 163 is defined by annular shoulder 171 on barrel portion 43 and annular shoulder 173 provided by the lower end of mandrel portion 35. Pressure ring 174 is engaged with the upper end of spring stack 169 and is engageable with shoulders 171, 173.

The lower end of pocket 162 is defined by annular shoulder 175 provided by the upper end of buried pin 38 connecting barrel portion 41, 42, and annular shoulder 177 formed by the upper end of mandrel portion 31. Pressure ring 183 is engaged with the lower end of spring stack 167 and is engageable with shoulders 175 and 177.

It will be apparent that for each spring means 151, 153 the mandrel is provided with upper and lower shoulders and the barrel is provided with upper and lower shoulders, and that since the mandrel and barrel shoulders do not overlap, they can pass each other whichever way the barrel and mandrel are moved axially relative to each other. Regardless of whether the damper is contracted or extended, pairs of mandrel and barrel shoulders will engage the pressure rings to cause the spring means to be compressed axially. Such action is indicated in the left and right hand halves of FIG. 3.

Neutral Position

Referring now to FIG. 1, the damper is shown in the unextended, uncontracted, or neutral position in which the spring means are of maximum length. In the neutral position, the shoulders 158, 160 on the mandrel flange 155 (FIGS. 3B', 3C') are co-level or in alignment with shoulders 159, 161 on barrel pin 46. At the upper end of spring means 153 (referring to FIGS. 3C' and 3C" for reference numbers but not for position), in the neutral position pressure ring 174 is engaged both with mandrel shoulder 173 and barrel shoulder 171. Similarly (referring to FIGS. 3A' and 3A" for reference numbers but not for position), in the neutral position pressure ring 183 is engaged both with mandrel shoulder 177 and barrel shoulder 175.

Travel Limits

A nut 189 is screwed onto a straight thread on the exterior of the upper end of mandrel portion 31. Nut 189 provides shoulder 191 at its lower end to engage barrel shoulder 175, forming therewith stop means limiting extension of the damper. Nut 189 is provided with a collar 193 which makes an interference (shrink) fit with the uppermost part of mandrel portion 31. A thin section 195 between collar 193 and the body of nut 189 facilitates sawing off the collar if the nut needs to be removed.

Pressure ring 183 is provided with an engageable surface 207 to engage shoulder 177 and an annular tongue 209 whose lower end 210 is adapted to engage shoulder 175. Tongue 209 spans nut 189 and the threaded connection between mandrel portions 31 and 33. Although the latter connection is a rotary shouldered connection as previously mentioned, it is also provided with an O ring seal 211 in case there is difficulty in applying adequate make up torque to the connection to effect a seal at shoulders 213, 215. Screw threads 217, 219 are straight (untapered) threads to facilitate make up.

The L-shaped cross-section of pressure ring 183, which provides tongue 209, permits shoulders 175 and 177 to be in different planes, i.e. non-coplanar, as occurs, e.g. because of the presence of nut 189.

Means limiting contraction of the damper is provided by stop shoulder 208 (FIG. 2A') on the lower end of the barrel and stop shoulder 210 on the lower part of the mandrel. It will be seen that the possible contraction of the damper from the neutral position equals the possible extension from the neutral position. However they could be made unequal if desired.

Pressure-Volume Compensation Means

Figure 3C:
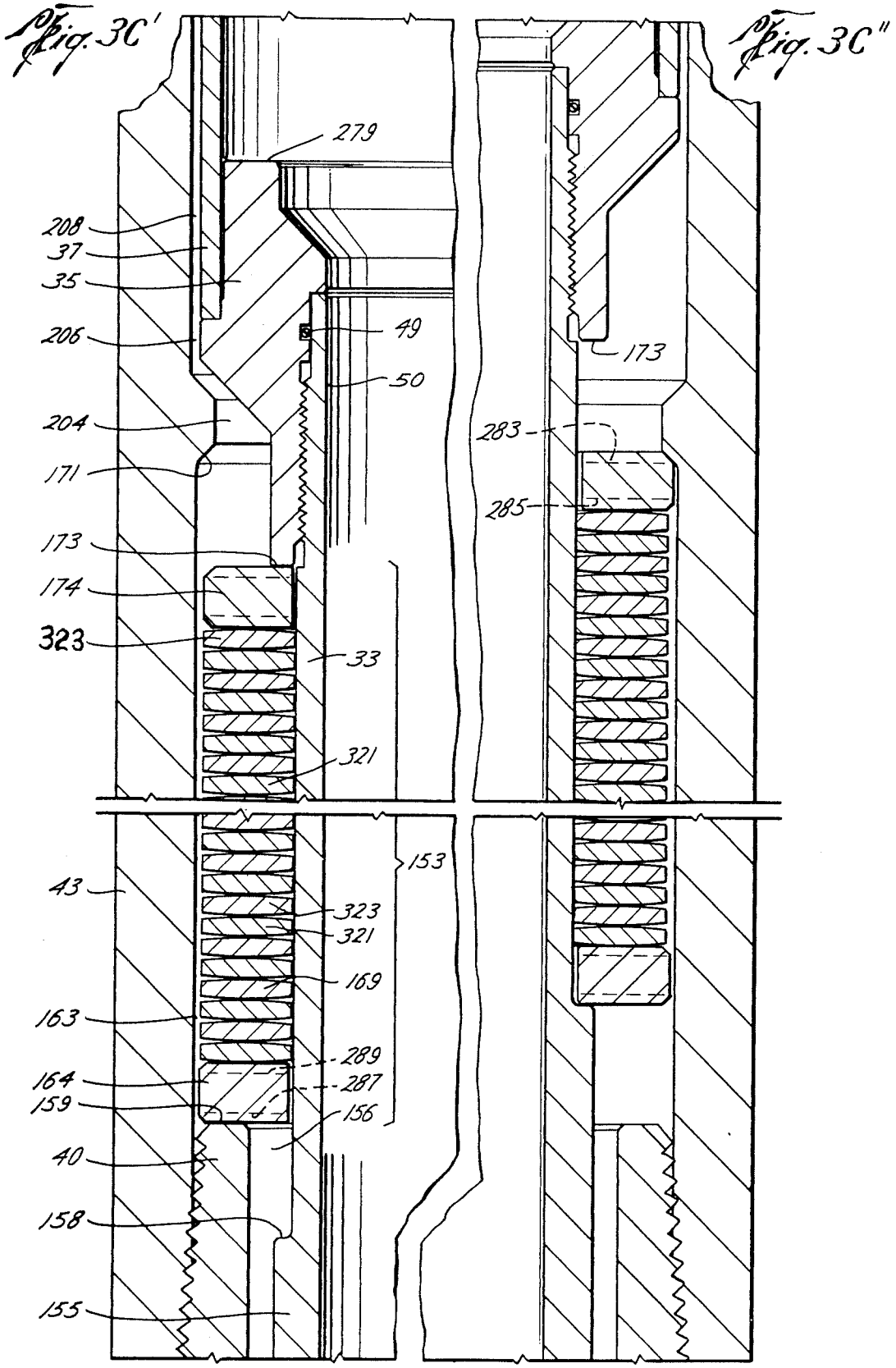

Referring now in part to FIG. 3C' and more particularly to FIG. 4, there is shown the upper part of the damper including mandrel portions 35 and 37 and barrel portions 43, 45, and 47. An annular volume 231 is formed between mandrel portion 37 and barrel portion 47. Due to the presence of cross over mandrel portion 35, mandrel portion 37 is of larger inner diameter than the outer diameter of the wash pipe formed by barrel portion 47; in other words, mandrel portion 37 is outside of barrel portion 47. Barrel portion 47 forms a part of and a continuation of the drilling fluid conduit means through the damper, which means, as previously mentioned, includes the passages 48, 50 through the interiors of tubular mandrel portions 31, 33.

Annular volume 231 between barrel portion 47 and mandrel portion 37 is closed by floating seal means 233 comprising tubular metal cartridge 235 carrying a plurality of sliding seal elements. Because barrel portion 37 is outside mandrel portion 47, an inversion of the usual barrel and mandrel relationship, any drilling fluid tending to flow through volume 231 must flow upwardly. Therefore detritus, sand and other particulates carried by the drilling fluid, when stopped by seal means 233, will fall down out of volume 231, away from seal means 233. For a discussion of downwardly facing seals, see applicant's French patent application Ser. No. 78/15034, filed 5-22-78, which presumably was published in print 18 months after the U.S. convention date based on U.S. patent application Ser. No. 799,770 filed May 23, 1977, now U.S. Pat. No. 4,182,425, issued Jan. 8, 1980.

Summarizing, there is no problem of drilling fluid particulates accumulating above the seal means at either the lower or upper end of the damper, since the spaces above these seal means are filled with lubricating oil and since at the lower faces of these seal means any drilling fluid particulates will fall out of the seal means due to the force of gravity.

Floating seal means 233 includes an upper set of double lip, spring loaded seal rings 237–240 on the interior of cartridge 235 to seal between the cartridge and the outside of wash pipe barrel portion 47. A lower set of similar seal rings 241–244 seal between the outside of the cartridge and the interior of mandrel portion 37 even if mandrel and barrel portions 37 and 47 are not exactly coaxial, the axial displacement of the upper and lower sets of seal rings allowing the cartridge to cant somewhat. Seal rings 237–244, similar to the seal rings in seal means 51 at the lower end of the damper, are provided with preload springs 245–252 to press their lips apart into sealing engagement with the cartridge and barrel and mandrel portions. Also, wedge rings 253–260 are provided to allow for stacking the seal rings in series, to transmit forces from one seal ring to another, and to facilitate retention. The wedge rings are provided with weep holes, e.g. as shown at 261, for pressure balancing as in the case of the wedge rings forming parts of the sealing means at the lower end of the damper. The seal rings and wedge rings are retained on the cartridge against upper and lower back up flanges 265, 267 by end rings 269–272 and snap rings 274–277, the latter being received in annular grooves in the ends of cartridge 235.

The whole seal means 233 is free to move as a unit axially up and down within volume 231, travel being limited by the upper end of the cartridge engaging annular shoulder 278 on washpipe barrel portion 47 and by the lower end of the cartridge engaging shoulder 279 on the upper end of mandrel portion 35. In normal operation the cartridge will never engage the stops. As long as the seal means is free to move, there is no pressure differential across it. It moves up or down so as always to be in contact with and supported by lubricating fluid 91 that fills the lubricant space between the barrel and mandrel in between pressure seal means 51 and floating seal means 233. Floating seal means 233 thus provides a pressure-volume compensator accomodating to changes in the volume of the lubricant space, allowing lubricating oil 91 to flow into the space 283 between washpipe barrel portion 47 and mandrel portion 37 when the lower part of the lubricant space between the barrel and mandrel reduces, and causing lubricating oil 91 to flow back into the space 283 when it enlarges, while keeping the lubricating oil separate from the drilling fluid at all times.

Lubricant Space

The space occupied by lubricating oil 91, extending from the lower part of the damper to the upper part thereof, may be traced from just above pressure seal means 51, past test probe electrode 93, between liner 121 and bearing surface 68, into space 281 between conical portions 123, 125, in between splines 131, 133, 135 and grooves 137, 139, 141, through flutes 147, through channels 282, 284 cut across the lower ends of nut 189 and tongue 209 (e.g. when the nut and tongue engage shoulder 175 as in FIG. 3A'), past the outer and inner peripheries of ring 183 (and its tongue 209) inside barrel portion 42 and outside mandrel portion 33, through spring pocket 162 inside and outside spring stack 167, between pressure ring 165 and shoulder 160 or 161 (one or the other is out of contact with the ring except in neutral position), or in neutral position through radial channels 286 (or 288) across the uppermost face of ring 165 as it happens to be assembled, through annular space 156 between barrel and mandrel, between pressure ring 165 and shoulders 159, 158 (one or the other is out of contact with the ring except in neutral position), or in neutral position through radial channels 287 (or 289) across the lowermost face of ring 164 as it happens to be assembled, through spring pocket 163 inside and outside spring stack 169, between ring 174 and shoulder 173 when out of contact or between ring 174 and shoulder 171 when out of contact (one or the other shoulder is out of contact except in the neutral position), or in neutral position through radial channels 283 (or 285) across the uppermost face of ring 174 as it happens to be assembled, through annular spaces 204, 206, 208, and into uppermost space 283.

Motion of Floating Seal

It is to be noted that when the damper is in use, the desired end result is zero axial motion of the barrel, which is connected to the upper part of the drill string, despite up and down motion of the mandrel, which is connected to the drill bit. As the mandrel moves up and down the volume of the space between the parts of the mandrel and barrel delimited by the lower seal means and the volume compensator changes and the compensator moves up and down to accomodate for the volume change. Large volume changes occur at space 281 between conical surfaces 123, 125 (FIG. 2) and at space 283 above the upper end of mandrel portion 37. Floating seal means 233 (FIG. 4) therefore moves up and down rapidly relative to both barrel portion 47 and mandrel portion 37 during operation of the damper. In the embodiment shown, the axial travel of the floating seal is about 3/5 of the axial travel of the mandrel relative to the barrel. For this reason the outer periphery of washpipe barrel portion 47 and the inner periphery of mandrel portion 37 are each provided with a hard metal coating, e.g. nickel plated, as shown at 275 and 276, such coating having a low friction coefficient and a smooth finish. Both wash pipe barrel portion 47 and mandrel portion 37 are readily replaceable should they become unservicable for any reason.

Although floating seal means 233 moves rapidly up and down to accomodate changes in volume of the space occupied by the lubricating oil, it may also move up and down more slowly in response to changes in the volume of the oil itself as temperature and pressure change.

Seal Position Indicator

Figure 4A:
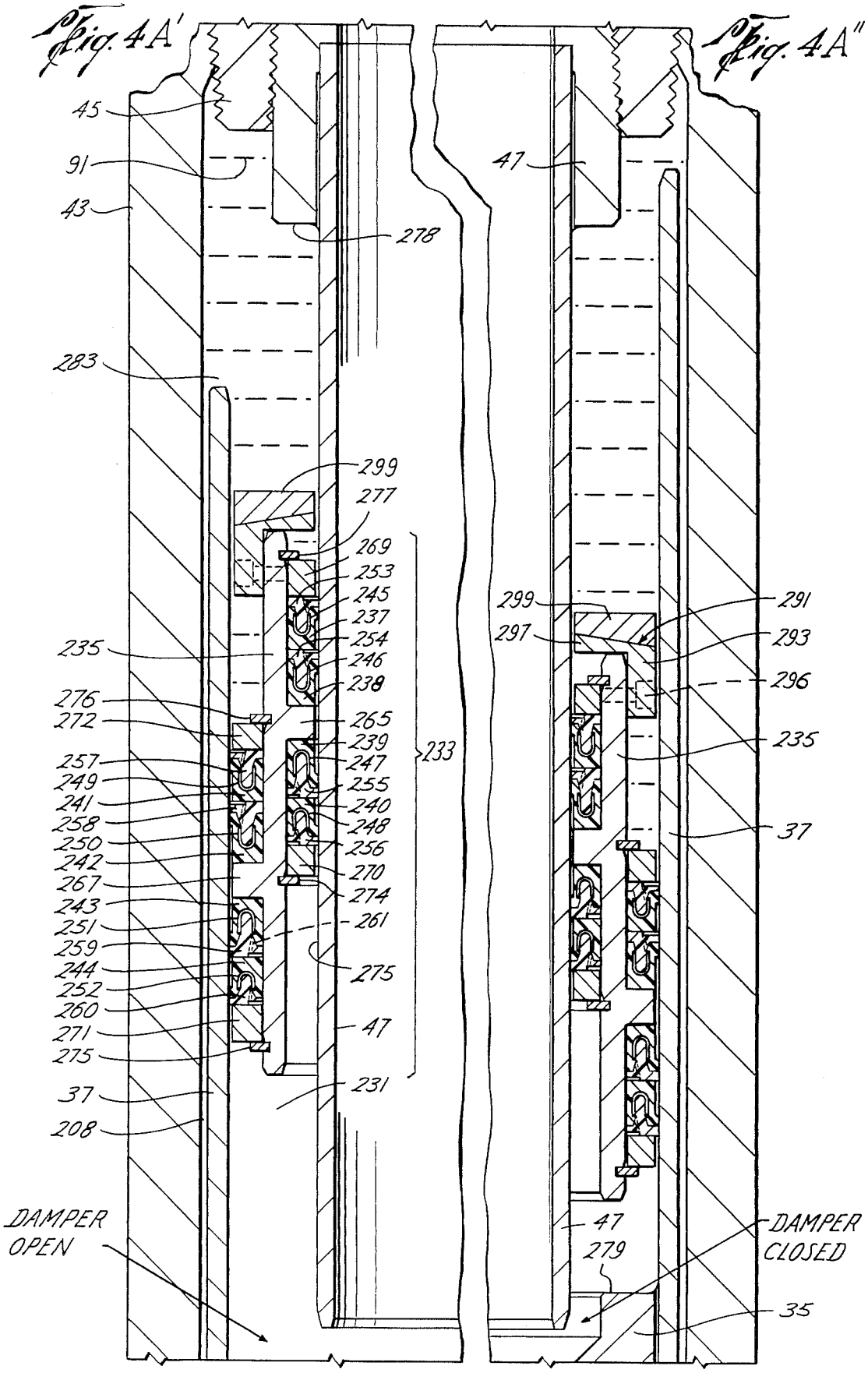
FIGS. 4A' and 4B', together hereinafter referred to as FIG. 4', are fragmentary sectional views, also to a larger scale than FIG. 1, showing the pressure volume compensating floating seal at the upper end of the damper being in the open or extended position.

Still referring to FIG. 4, on the upper end of cartridge 235 is disposed a cap 291 having a skirt 293. A plurality of screws 296 circumferentially spaced apart around the skirt extend through holes in the skirt into threaded holes in the cartridge. The upper end 297 of cap 291 has a conical top face pointing upwardly. Surmounting the cap is permanent magnet ring 299, which has a lower conical face correlative to the top face of cap 291, being suitably secured thereto, e.g. by epoxy cement or by sintering or soldering. Magnet ring 299 is magnetized radially, whereby its inner periphery is of one polarity and its outer periphery is of an opposite polarity. Cartridges 235 and wash pipe 47 are made of non-ferromagnetic material, such as stainless steel. A magnetic pipe, such as a steel building stud locator, lowered into wash pipe 47, will indicate the level of the magnet ring and hence of the floating seal. If the damper is fully contracted, as shown in FIG. 4A'', the floating seal should be near its lowermost normal position due to the lubricant flowing into the space 283 at its top side. If the damper is fully extended, as shown in FIG. 4A', the floating seal should be near its uppermost normal position, due to the lubricant flowing away from space 283 at its top side. If the damper is in its neutral position, the seal should be in a normal median position, as shown schematically in FIG. 1.

If the seals leak so that there is a loss of lubricant from the chamber, the floating seal will be near its uppermost position, or at least above its normal position. If the seals leak in a manner that intrusion of well bore fluid increases the fluid in the chamber, the floating seal will be at its lowermost position or at least below its normal position.

Of course in both conditions, insufficient and excess liquid in the chamber, the problem may not be with the seals but rather be one of initial insufficient or excessive filling of the chamber with lubricant. Whatever the problem is, it can be corrected.

Springs

Referring again to FIG. 1, and more particularly to FIG. 3, each of spring stacks 167, 169 comprises a plurality of Belleville spring washers 321 positioned with their cones pointing up, interleaved with a plurality of Belleville spring washers 323 disposed with their cones pointing down. This mode of stacking places the spring washers in series. The more spring washers in series, the greater the damper deflection for any given axial load. The use of two spring stacks in parallel reduces the stress in each Belleville spring washers for any given deflection of the damper. If required, additional stacks of spring washers beyond two stacks e.g. three, four or more stacks may be parallel to keep the stress in each Belleville spring washer below the elastic limit or below the endurance limit or any other desired limit.

It may be noted that merely making the spring washers thicker or stacking some of the Belleville spring washers in each unit in parallel, that is with their cones pointing in the same direction, though reducing some of the stresses in the spring washers, will not change the localized stresses over the areas of contact between adjacent oppositely pointed spring washers, which stress may be very high due to the nearly line contact between such spring washers and will not change the localized tensile stresses on the faces of the spring washers opposite to their areas of contact, and furthermore, in the case of springs paralleled within the stack, will cause sliding friction between the springs thus paralleled. Therefore paralleling several stacks may be necessary.

Due to manufacturing tolerances, the length of a spring stack of a preselected number of spring washers may not exactly fit the cavity between mandrel and barrel. In such case, as shown only in FIG. 1, one or more flat washers or shims 280, 282, 284 may be employed to achieve the desired flat. Alternatively, pressure rings 164, 165, 174, 183 (FIG. 3) of varying thickness may be employed.

Variable Moment Belleville Springs

Due to the small scale, FIG. 1 shows spring stacks 167, 169 to be composed of ordinary Belleville spring washers, i.e. with cross sections having straight sides. Although such springs may be employed while obtaining some of the advantages of the invention, and may even be constructed to provide a variable modulus as set forth, e.g. at pp. 155–157 of Mechanical Springs, by A. M. Wahl, Second Edition, published by McGraw Hill Book Company, 1963, it is preferred to use variable moment arm Belleville springs of the general type disclosed in the aforementioned Migny patent. Furthermore it is preferred to use a particular form of variable moment arm Belleville spring, herein termed a roller Belleville spring, in which there is pure rolling between adjacent washers as they are loaded and unloaded, as next described.

Roller Belleville Springs

The Belleville spring washers 321, 323 are identical, merely being positioned oppositely during assembly. Such a spring washers is shown to a larger and more precise scale in FIG. 7. As there shown, the radius $R'=R''$ of the outwardly and inwardly tilted faces of the spring washer is 10-11/64 inches. The outer diameter of the spring washer is typically 5.827 inches. The spring washer thickness is 0.250 inch and the cone angle is 3.75 degrees measured at the part of the spring washer midway between its inner and outer peripheries. It will be noted that the center 0'' of the radius R'' for the outwardly facing face (the left hand face in FIG. 7) of the washer lies substantially on a line through the inner peripheral edge of such face parallel to the cone axis C of the washer. When the washer is stacked with others and assembled in the damper, the slight preload in the neutral position will cause the center of such radius R' to be exactly on said line.

Similarly it will be noted that the center 0′ of radius R′ for the inwardly facing face (the right hand face of FIG. 7) of the washer lies substantially on a line through the outer peripheral edge of such face parallel to the cone axis of the washer. When the washer is stacked with others and assembled in the damper, the slight preload in the neutral position will cause the center of such radius R″ to be exactly on said line.

With 0′ and 0″ so located for the neutral position of the damper, and R′ being equal to R″, the contacting areas of the washers of the inner and outer peripheries of the stack will, be tangent; when the damper is deflected the contacting areas of the washer move closer together and remain tangent, the washers rolling upon each other without sliding. It will be noted that when the contacting areas of the washer move together so as to be in vertical alignment, that is, so that they are equidistant from the axis of the washers, the moment arm becomes zero and the spring has gone solid. During the motion from unloaded condition to the solid condition, only the inner portions of the washer faces that are in contact nearest the washer axis are engaged and only the outer portions of the washer faces that are in contact farthest from the washer axis are engaged, such portions being the functional portions of the surfaces. The non-functioning portions of the washer surfaces never engage any other surface.

With the foregoing background, the conditions for pure rolling of the washer may be summarized as follows:

(1) The contacting areas of the faces of the washers are tangent, to avoid pivoting.

(2) The washers are identical, i.e. of like size, thickness, dish (cone angle), and facial curvature, so that they will have equal angles of deflection and the same position of their neutral axes, as required to avoid slippage.

(3) To avoid sliding, the curves of the functional portions of the two opposite faces of each washer should be the same, i.e. one curve would be the double reflection of the other about a medial cone and a cone perpendicular thereto (complementary therewith).

(4) The curves of the functional portions of the cross sections of the surfaces of the washers must be continuously convex, to avoid bridging.

For further discussion of this subject, see the aforementioned companion application of James B. Hebel.

Spring Clearance and Guidance

Figure 5:
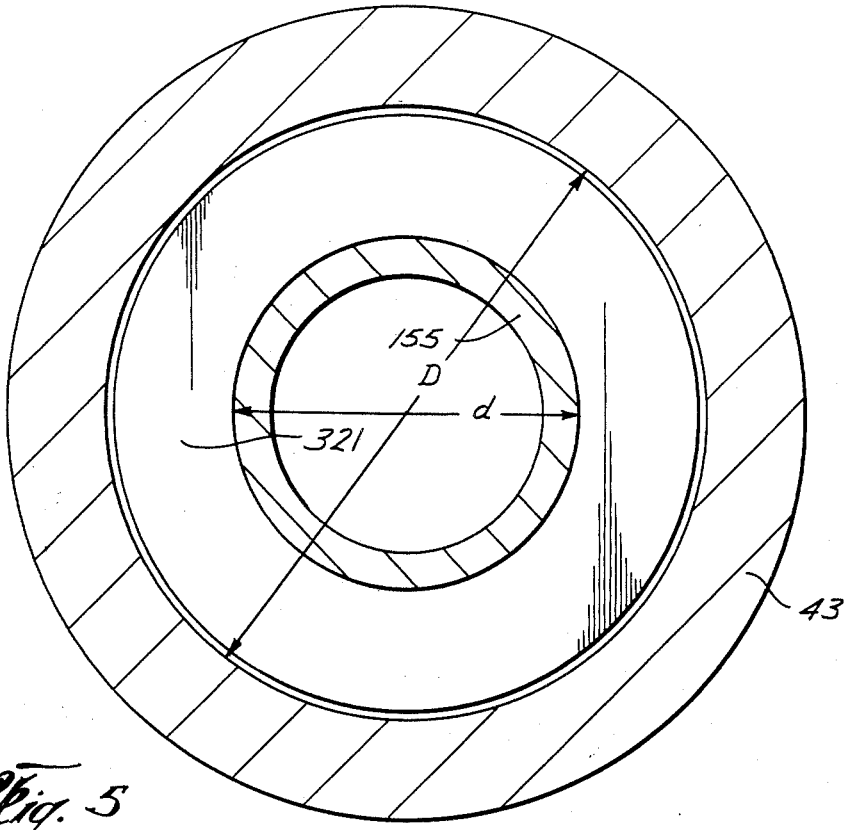
Figure 10:
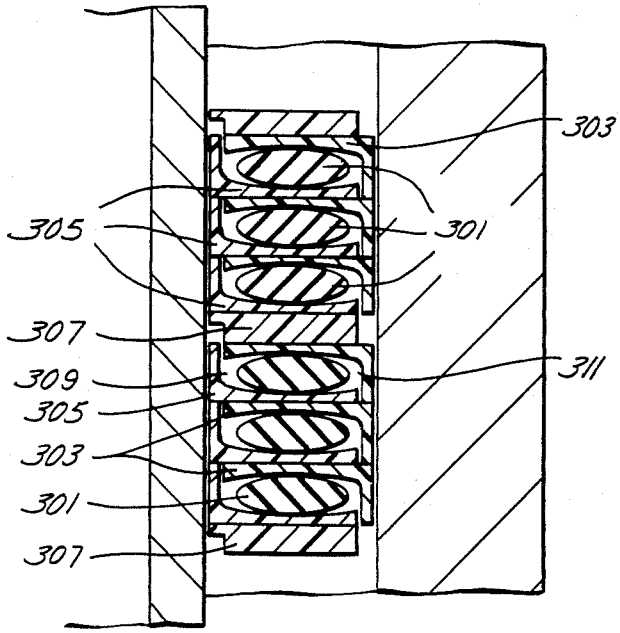
FIG. 10 is a fragmentary sectional view showing a modified form of resilient means.

Referring once more to FIG. 7 the minimum diameter of the inner periphery of the washer is 03.543+0.005 inches, which is enough larger than the diameter d of the outer periphery of mandrel 33 (FIG. 5) that the spring washers can freely move up and down axially relative to the mandrel even when the damper is extended or contracted causing the washers to be compressed (flattened). If any part of the spring stack moves laterally, the mandrel will limit the movement, one or more of the spring washers making line contact with the side of the mandrel. The inner corners of the cross-section of the spring washer are more fully rounded to avoid cocking on the mandrel during assembly and to reduce stress concentration.

The outer periphery of the spring washers is considerably smaller than the inner diameter D (FIG. 5) of the barrel, so that the washers can expand circumferentially when they are compressed (flattened), as the damper extends or contracts, and still remain out of contact with the barrel. Also, there is left plenty of room for lubricating oil 91 to move past the washers.

If desired, the washers could more nearly make a close fit with the barrel and, at the same time, if so desired, less nearly make a close fit with the mandrel, relying on the barrel to limit lateral travel of the springs.

Figure 7:
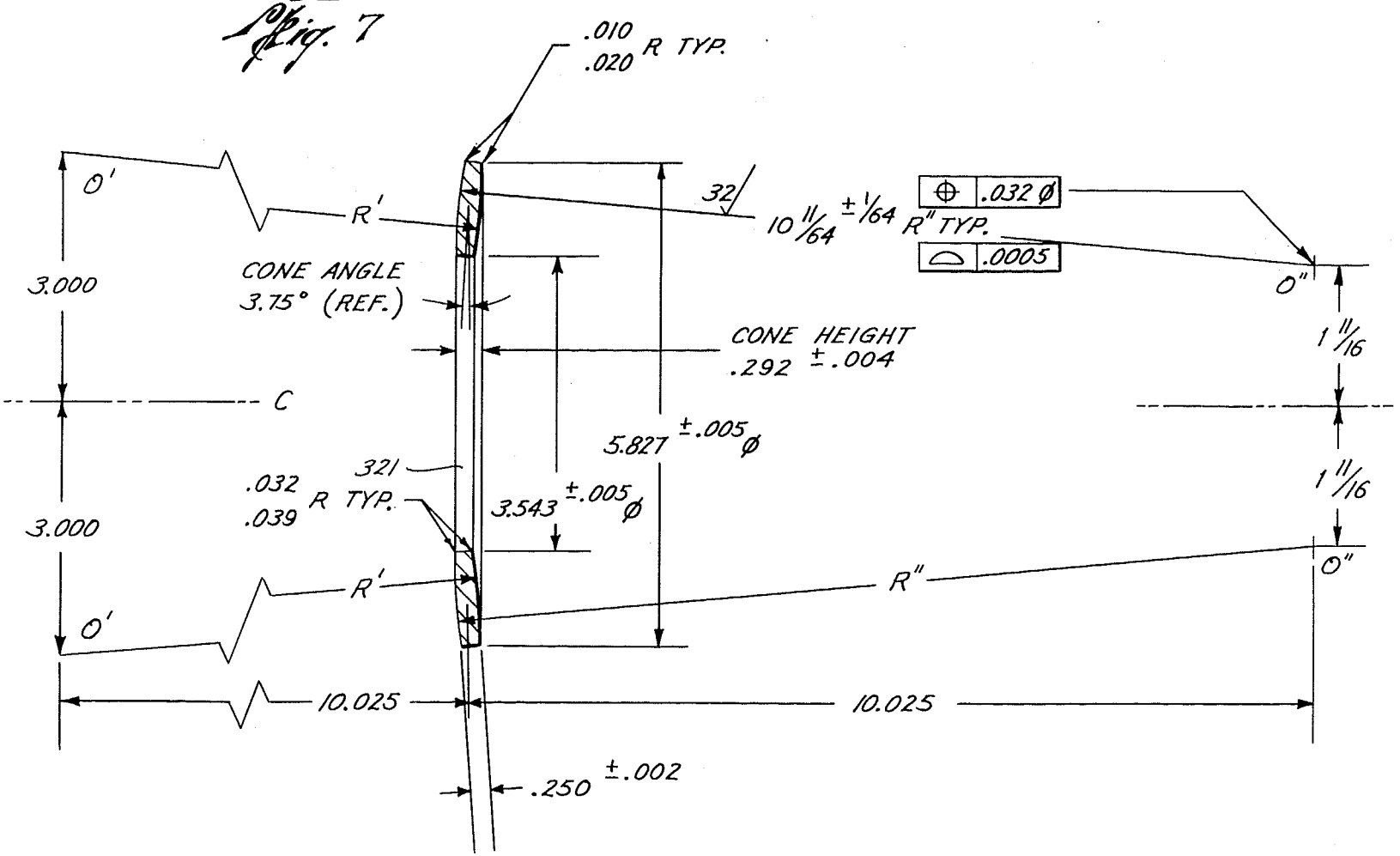
FIG. 7 is a sectional view of one of the roller Belleville spring elements.

The minimum radial clearance betweenthe inner and outer peripheries of the washers, and the adjacent outer periphery of the mandrel and inner periphery of the barrel required to accommodate for change in the spring washer diameters when flattened is only a few thousandths of an inch, which is less than that required by manufacturing tolerances. Such tolerance, as shown in FIG. 7, may be plus or minus 0.005 inch for the inner and outer diameters of the washers, i.e. of the order of several thousandths of an inch.

Variable Spring Modulus

The spring stacks, when assembled in their respective pockets, are slightly compressed even when the damper is neither contracted nor extended, but only just enough to keep them from being loose in the pockets. In this condition, as shown in FIGS. 1 and 7A, the spring washers are in contact over circular areas near their inner and outer peripheries, each spring washer contacting either the inner or outer periphery of the spring washer above and the opposite (outer or inner) periphery of the spring washer below. This is the unloaded condition of the damper.

When the spring stacks are compressed, upon either contraction or extension of the damper, the circular areas of contact between the spring washers move away from the peripheries toward each other, i.e. towards the mid widths of the washers, as shown in FIG. 3. This results in a reduction of the leverage of the axial forces on the spring in their action to flatten the washers, causing the spring rate (force/deflection ratio) to increase. Roller Belleville springs thus have a pronounced variable spring modulus.

Figure 8:
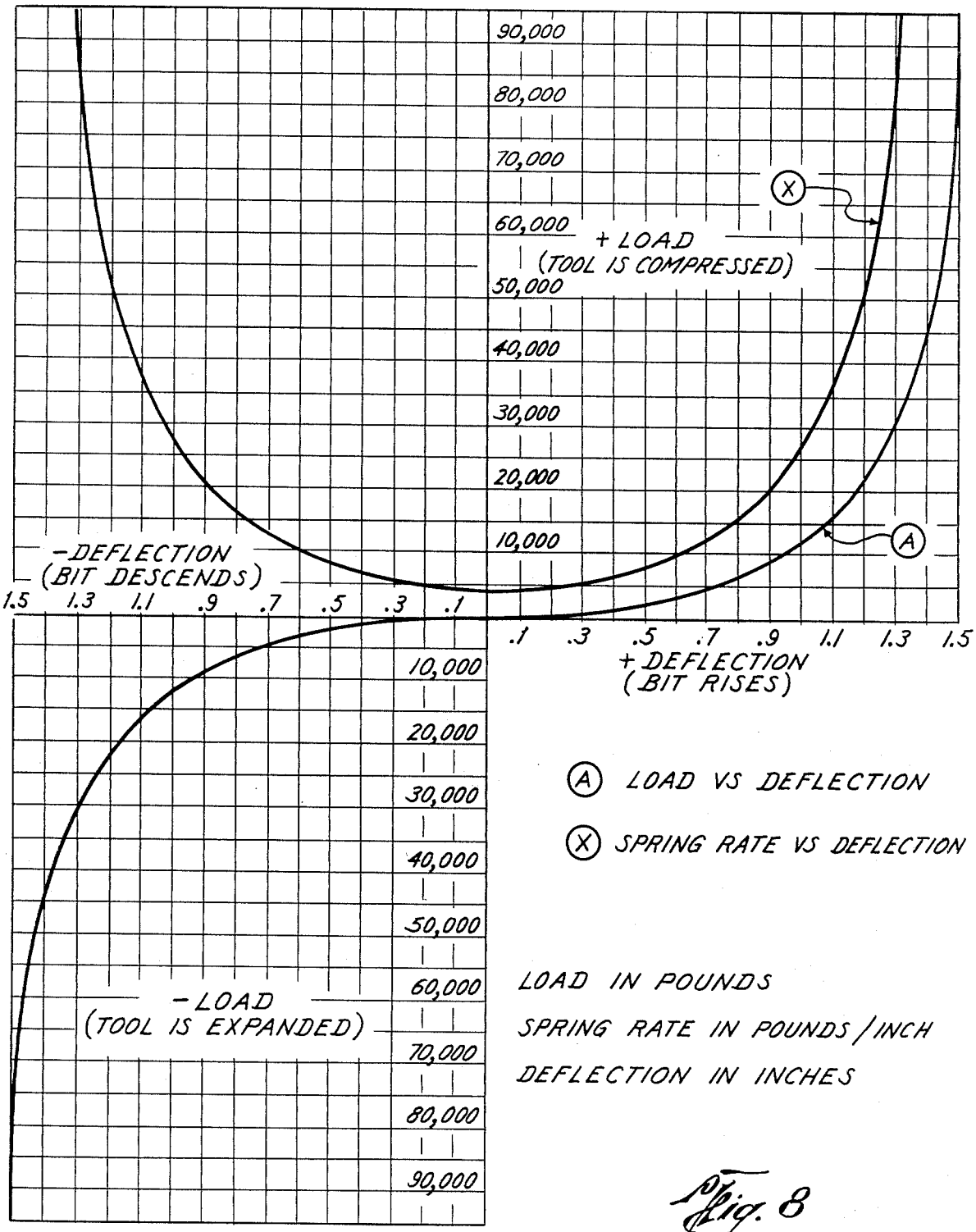

Referring now to FIG. 8, there are shown a curve A plotting spring force versus deflection, and also a curve X plotting spring rate versus deflection. Curve X shows a very low spring rate of the order of 4,000 to 10,000 lb./in. at moderate values of spring deflection, reflecting the low slope of the nearly straight line portion of the spring force deflection curve A below 10,000 lb. At a deflection of 1.0 inch, corresponding to a spring force of 12,500 lb., the spring rate is still less than 30,000 lb./in. Even at a deflection of 1.3 inches, corresponding to a spring force of 30,000 lb., the spring rate is but 85,000 lb./in. Only as the deflection approaches the travel limit of 1.5 inches does the spring rate exceed 100,000 lb./in. to bring the damper travel to a cushioned stop.

Double Action

FIG. 8, curve A, also shows that for negative loads, i.e. loads tending to extend the damper, the load deflection curve is reflected about the ordinate. In other words, the same load deflection curve, except with negative deflections, applies. That is because the resilient means is being stressed regardless of whether the damper is being contracted or extended. In fact, in the preferred embodiment the same spring means is strained in the same way (flattened) regardless of whether the damper is contracted or extended.

Balanced Load Drilling

Referring now to FIG. 9, there is shown curve A, which is the same as curve A of FIG. 8, plotting spring force as a function of spring deflection. FIG. 9 also shows a curve B plotting spring force as a function of decreasing spring flexibility, that is, the abscissae scale of curve B has its origin at a flexibility of 25 inches per 100,000 pounds, with decreasing flexibility proceeding away from the origin. Also, flexibility is plotted as positive both to the left and to the right of the origin; this accounts for the fact that the flexibility curve includes a portion in the lower left hand quadrant rather than in the upper left hand quadrant. Flexibility is the reciprocal of spring rate; therefore curve B is closely related to curve X of FIG. 8. However spring rate curve X is plotted against deflection whereas curve B plots spring force against flexibility. Note further that in curve X, spring rate is plotted as ordinates, whereas in curve B flexibility is plotted as abscissae. In fact in FIG. 8, one should consider the abscissae, the deflection, as the independent variable, reflecting the fact that the bit moves up and down as the contour of the bottom changes, to some extent regardless of what force is imposed on the bit, whereas FIG. 9 is best appreciated viewing the ordinates, the spring force, as the independent variable, reflecting the information known to the driller, i.e. the static load on the damper.

It may be noted here that although the static load on the damper is the difference between the drilling weight and the pump apart force, the load on the bit is the drilling weight, unaffected by the pump apart force. Although the pump apart force acts down on the bit, it also acts upwardly on the swivel to relieve the drawworks of some of the drill string weight. Since drilling weight is calculated on the basis of weight of drill string less line tension, the upward pump apart force, which actually further reduces the unsuspended weight of the drill string, equals the downward pump apart force acting to increase the force on the bit over that which is due to the unsuspended weight of the drill string. In other words, the pump apart force is neglected twice with opposite effect.

FIG. 9, in the upper left hand quadrant, includes a table showing typical drilling conditions. The items in the table, and elsewhere in FIG. 9, that are marked with a check mark, correspond to a near balanced load condition, CONDITION I, including an average drilling weight of 45,000 pounds and an average pump pressure of 1,500 psi corresponding to a pump apart force of 44,000 pounds. The items marked with an asterisk correspond to an extreme condition, CONDITION II, wherein the pump apart force dominates, the pump pressure of 2,000 psi producing a pump apart force of 59,000 pounds compared to a drilling weight of only 30,000 pounds, a difference of 29,000 pounds acting to expand or extend the damper. The items marked with a double dagger correspond to an extreme condition, CONDITION III, wherein the drilling weight dominates, the pump pressure of only 1,000 psi producing a pump apart force of only 29,000 pounds compared to a drilling weight of 60,000 pounds, a difference of 31,000 pounds acting to compress or contract the damper.

Having noted the parameters in the upper left hand quadrant of FIG. 9, one may refer to the scale of pump pressures at the lower left hand side of FIG. 9. There, selecting a pump pressure of 1,500 psi, marked with a check mark, and following the heavy line in the direction of the arrows, one finds that this pressure corresponds to 44,000 pounds of pump apart force, a negative force, i.e. one expanding the damper, to which one adds a positive force of 45,000 pounds of drilling weight to provide a net force of 1,000 pounds contracting the damper, at which load the flexibility of the damper is a maximum, i.e. 25 inches per 100,000 pounds. This is CONDITION I.

Further exploring FIG. 9, one may start at the lower left at a pump pressure of 2,000 pounds marked with an asterisk, and following the dotted line one first notes that this pump pressure produces a pump apart force of minus 59,000 pounds. To this is then added a drilling weight of 30,000 pounds leaving a net negative force of 29,000 pounds expanding the damper, at which point the flexibility of the damper is 0.85 inch per 100,000 pounds. This is CONDITION II.

Condition III may also be traced on FIG. 9, starting at the lower left with a pump pressure of 1,000 psi, marked with double dagger. Following the broken line one finds that 1,000 psi pressure corresponds to a pump apart force of minus 29,000 pounds. Adding a drilling weight of 60,000 pounds creates a net contractive force on the damper of 31,000 pounds, which corresponds to a flexibility of 0.80 inch per 100,000 pounds, substantially the same as for CONDITION II.

Assuming a case wherein the pump apart effect balances the unsuspended weight of the drill string (drilling weight), identified as CONDITION I in FIG. 9, there is no static load on the damper spring and the damper will operate about the zero load, zero deflection point, the origin of the FIG. 9 load-deflection curve, which is the neutral position as previously defined. The damper will then be very soft and very little motion will be transferred to the drill string. This is in contrast with single acting variable modulus dampers in which under balanced load condition alternate half cycles of vibration would cause engagement of the travel stops, thereby losing the benefit of the low spring rate on alternate half cycles of damper vibration.

Consider next the case of drilling with unbalanced load. As the unbalance increases, the flexibility at the static deflection point decreases. However, at a load unbalance of plus or minus 10,000 lb., the flexibility is still over 4 inches per 100,000 lb., which is very high, and the deflection is about 0.95 in. which leaves 0.55 inch of travel to the nearest travel stop.

It may be noted here that the drop in flexibility from 25 inches per 100,000 pounds under balanced load conditions to 4 in./100,000 lb. at 10,000 pounds unbalance appears to be major. However the amplitude of transmitted vibration to impressed vibration is actually more nearly a function of the reciprocal of flexibility, i.e. of spring rate, and as appears from FIG. 8, at a deflection of 0.95 in. the spring rate is only about 23,000 pound/in., which is still quite low.

If the drilling weight exceeds the pump apart effect, or vice versa, by thirty thousand pounds, the conditions are those identified on FIG. 9 as CONDITION II and CONDITION III. Conditions II and III represent extreme conditions of load unbalance which are met in practice perhaps only about 5 percent of the time. However even under these conditions although the action of the damper is not as good as under balanced load, the damper, having a flexibility of 0.8 or more and a travel of 0.2 in to the nearest stop, is still soft enough to dampen substantially transmission of vibration to the drill string. The damper therefore may be used with varying degrees of effectiveness over a typical range of drilling weights in the range from 30,000 pounds to 60,000 pounds and pump apart forces in the range from 30,000 pounds to 60,000 pounds corresponding to a $6\frac{1}{8}$ inch diameter seal area (e.g. 8 inch diameter damper) with pump pressure in the range of 1,000 psi to 2,000 psi.

Stroke

Assuming the drill string above the damper to be at rest vertically, the damper needs to have sufficient contractive and extensive stroke to allow for the maximum anticipated rise and fall of the drill bit without having the damper become inoperative by the travel limit stops becoming engaged or the springs reaching their limit of deformation (going solid i.e. flat in the case of Belleville springs). It will be seen from FIG. 8 that the damper has a working range of plus or minus one inch deflection with a very low spring rate when the pump apart effect balances the drilling weight. Even at the extreme condition of a thirty thousand pound difference (plus or minus) between drilling weight and pump apart effect, there is still available a travel of about 0.2 inch in the direction toward the nearest travel limit stop before the spring rate of the spring stacks becomes exceedingly high.

Parallel Stacks

Figure 9A:
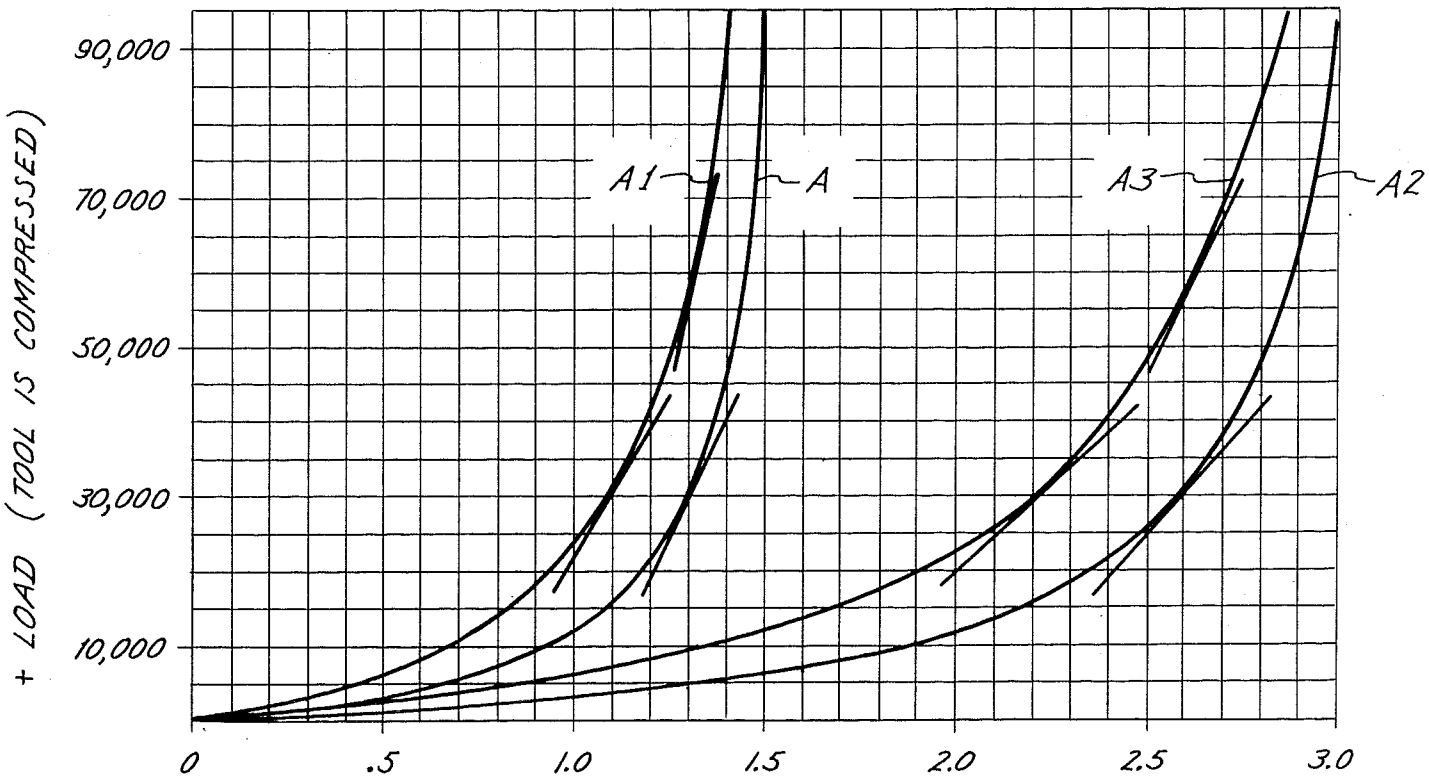

If one is willing to accept a higher spring rate at balanced load, the available travel to the nearest stop for any given unbalanced load and the spring rate at that load can both be enhanced by employing additional stacks of springs in parallel. Referring to FIG. 9A, curve A shows the load deflection curve for the previously described apparatus. Curve A1 shows the result of employing four stacks of springs in parallel (twice as many as for Curve A). It is seen that although the spring rate for balanced load is doubled (twice the slope), it is still very low, and at 30,000 lb. static load the deflection is only 1.1 inch, leaving 0.4 inch travel to the nearest stop (compared with 0.2 in. for curve A) and the spring rate is lower (lower slope) than for curve A.

Curve A1 also shows that at 60,000 lb. static load (twice the limit of the working range for the damper of Curve A) the deflection is only 1.3 inches, the same as for a 30,000 lb. load in the case of the curve A damper (although the spring rate is greater for curve A1 at 60,000 lb. than the curve A at 30,000 lb.

Summarizing, by putting more variable modulus springs in parallel, one can not only reduce the deflection, but also reduce the spring rate at the same 30,000 lb. static load, or increase the static load for the same 1.3 inch deflection.

If an overall longer stroke is required, the lengths of the spring stacks can be increased. For example, referring now to curve A2 of FIG. 9, by doubling the length of the spring stacks, the low spring rate working range would become plus or minus two inches, and there would be a travel of about 0.4 inch to the nearest travel stop when static load is unbalanced by 30,000 pounds.

Lengthening the spring will also lower the spring rate in the middle of the range, e.g. at the neutral position. Therefore if it is desired to increase the working range at unbalanced loads as well as increase the stroke, without sacrificing flexibility at any load, additional stacks of springs in parallel may be employed. For example, by both doubling the lengths of the springs and employing twice as many in parallel as shown in curve A3, the same low spring rate at midrange as for curve A will be achieved, and the unbalanced load working range for the same maximum spring rate within the range will be increased to plus or minus 60,000 lb. with a travel limit of 0.4 inches to the nearest stop.

It is to be particularly noted from curve A3 that by doubling the spring length and the number of stacks in parallel, the travel to the nearest stop at plus or minus 30,000 pounds would be increased to 1.08 inches and the spring rate would be only about 25,000 lb/in. This improved effect achieved with the seriating and paralleling of variable modulus springs is in contrast with that achieved with constant modulus springs where only the travel to nearest stop would be increased without any change in spring modulus.

COMPARISON

The subject construction with a stroke of plus or minus 1.5 inches and a spring rate of 30,000 lb./in. or less over a range of plus or minus one inch when operating under balanced load conditions, is to be compared with the result that would be obtained with a constant spring rate and with single acting spring means.

First of all consider the situation with a constant spring rate single acting spring means having a spring rate of 4,000 lb. per inch, corresponding to the spring rate of the present construction at zero deflection. Upon imposition of a static load of thirty thousand pounds, the deflection woule be 7.5 inches, which is way beyond the range of travel of the assumed situation. To accomodate such a stroke, the seals, spline, and guide bearings would all have to be lengthened, as well as providing a spring of such a stroke. The question arises if this problem could be overcome merely by changing the position of the travel limit stops. The answer is simply, no. If the stops were set to limit deflection to plus or minus 1.5 inch, upon imposition of an unbalanced static load of only 6,000 pounds the damper would be in engagement with one stop and therefore inoperative on alternate half cycles.

At this point one may introduce the concept of the load carrying capability of a spring. This is the maximum load which a spring can carry without going solid, or otherwise expressed, the maximum load which a spring can carry and still function as a spring, i.e. as a device in which the ratio of load to deflection per unit length of spring is less than the modulus of elasticity of the material of which the spring is made. In the instant case, unless the spring of the spring means has a load carrying capacity of thirty thosand pounds, it will not be effective as a spring upon imposition of a 30,000 pound load, no matter where the travel limit stops are placed. If a spring is soft, it likely will have a low load carrying capacity.

Consider next a damper with a constant spring rate of 30,000 lb./in., near the maximum rate for the damper of the present invention, when operating under balanced load conditions. Under a static load of 30,000 lb., the spring deflection would be one inch, leaving only a half inch of travel to reach the nearest travel limit stop. Since a one inch deflection is to be expected according to the original assumptions, such a damper would strike its travel limit stop once during each cycle of vibration, there being no increasing modulus as the stop is approached to cushion the end of the travel.

To provide a one inch travel to the nearest stop when operating with a 30,000 lb. static load, the spring rate would have to be such that the static deflection would be only one-half inch ($1.5-1.0=0.5$). In other words, a constant spring rate of 30,000/0.5 = 60,000 lb./in. would be required. This is fifteen times as stiff as the zero deflection spring rate of the previously described construction embodying the invention. In addition, should there be any abnormal deflection of a damper with the assume 60,000 lb./in. constant spring rate, the damper would strike its travel limit stop. In contrast, the spring means of the present construction, being of increasing spring rate as the deflection approaches the limits, will still effect a cushioned stop upon abnormal deflection, even though the cushioning will be less than under normal conditions.

Consider next the case of a known damper employing a variable modulus spring but with single action. Such a damper operating under balanced load would strike its travel limit stop once during each vibration.

CONSTANT BIT LOAD DRILLING

The type of drilling contemplated by the present invention may be further understood by referring once more to FIG. 8. It will be seen from curve X that for deflections between plus and minus 0.5 inches the spring rate is nearly constant and quite low. Therefore, if drilling is conducted in such a manner that the pump force balances the drilling weight so that the static deflection of the damper is zero, the damper will allow the drill bit to move up and down following the contour of the bottom of the hole under the constant downward force of the pump apart force with very little force variation transmitted to the drill string through the damper. Since the bit will remain in contact with the bottom of the hole with the desired force on bottom, drilling should proceed in a most efficient manner and at the same time there will be minimum wear and tear on the drill string.

MODIFICATION

Although according to the preferred embodiment of the invention roller Belleville springs are employed, variable modulus spring means other than roller Belleville springs may also be used.

As an example of the latter construction, FIG. 9 illustrates a form of spring stack to be disposed in a damper pocket, similar to the pockets 162, 163 in the previously described embodiment. The stack comprises ovoid cross-section elastomer quoits 401 each sandwiched between pairs of L-shaped cross-section steel washers 403, 405 which slide freely in the pockets between mandrel and barrel. The washers are in peripheral engagement, placing the quoits in parallel. Groups of paralleled quoits, e.g. group of three quoits, are separated by steel spacers 407 placing the groups in series. With this arrangement, by selecting the number of quoits in a group, the total number of groups, and the cross-sectional shape of the quoits, most any stress limit on the quoits and travel range for the damper can be obtained. As compared with roller Belleville springs, a softer, no load spring rate will be typical, with a sharply increasing rate as the elastomer quoits deform and the metal washers come closer together and the elastomer fills the voids 409, 411 present at the inner and outer peripheries of the quoits when unloaded.

Though the rubber quoit sandwich construction has the advantages of greater softness, a disadvantage is the fact that rubber cannot be used in high temperature wells. Also, rubber has considerable hysteresis or internal friction which may reduce the life of the spring means.

While a preferred embodiment of the invention and a modification thereof have been shown and described, many further modifications can be made by one skilled in the art without departing from the spirit of the invention.

I claim:

1. Rotary drill string damper comprising a splined, sealed, tubular, telescopic joint including resilient means increasingly strained upon both extension and contraction of the joint from a neutral position and having a like variable spring modulus upon both extension and contraction with a lowest modulus at the neutral position and nearly as low like moduluses at equal departures from neutral position to both sides of the neutral position over a range of such departures and like gradually and then sharply higher moduluses upon increasing equal departures beyond said range upon further extension and contraction of the damper.

2. Deep drilling vibration damper comprising:

an inner tube adapted at one end for connection to a drill string component, an outer tube adapted at one end for connection to a drill string component, the other end of the inner tube being telescopically disposed within the other end of the outer tube, axially spaced means sealing between said inner and outer tubes defining volume between said tubes which volume contains lubricant, and disposed in said volume torque transmission means to transmit torque between said tubes and resilient means to transmit axial force between said tubes, said resilient means including in parallel a plurality of groups of series stacked spring rings, said spring means being increasingly strained upon both separation and approach of said one of said tubes from a neutral position and having a variable spring modulus increasing upon wide departure of said tubes from neutral position.

3. A drill string vibration damper comprising a splined tubular telescopic joint and spring means urging the joint back to a certain position upon both extension and contraction of the joint with equal force exerted by said spring means upon equal departures away from said certain position by extension and by contraction of the joint, said spring means having an increasing spring modulus upon departures from said certain position in both directions.

4. Damper according to claim 3, said spring means comprising series stacked spring rings urging the joint back to a certain position upon both extension and contraction of the joint away from such certain position, the unstressed length of the stack of spring rings that is strained upon the extension of the joint equaling the unstressed length of the stack of spring rings that is strained upon the contraction of the joint.

5. Damper according to claim 3, said spring means including a plurality of paralleled groups of series stacked spring rings.

6. Damper according to claim 3, said spring means including a plurality of series groups of parallel stacked spring rings.

7. Damper according to claim 3, said spring means including a plurality of parallel groups of series subgroups of parallel stacked spring rings.

8. A drill string vibration damper comprising a splined tubular telescopic joint and spring means urging the joint to a certain position upon both extension and contraction of the joint with equal force exerted by said spring means upon equal departures from said certain position by extension and contraction of the joint, said telescopic joint including a mandrel and a barrel and axially spaced seal means sealing between the mandrel and barrel defining volume between said mandrel and barrel adapted to receive lubricating fluid, said spring means being disposed in said volume, one of said seal means being sliding pressure seal means and the other of said seal means being floating seal means, and magnet means carried by said floating seals means to facilitate determination of the position of the floating seal means.

9. Damper according to claim 8, including an electric conductor extending through said joint from the exterior thereof into said volume to contact said lubricant.

10. Damper according to claim 8, said barrel including a wash pipe extending inside the end of said mandrel, said floating seal means comprising annular means around the outside of the wash pipe and inside the mandrel, said magnet means comprising a permanent magnet carried by said annular means.

11. Damper according to claim 8, both of said seal means having lower and upper faces disposed with their upper faces to be adjacent lubricant when said volume is filled with lubricant whereby particulates carried by drilling fluid both inside and outside the joint will fall away from the seal means.

12. Apparatus according to claim 8, said floating seal means including upper and lower annular resilient seal means adapted to seal one with one of said barrel and mandrel and the other with the other of said barrel and mandrel.

13. Apparatus according to claim 12, said upper seal means sealing with the barrel and the said lower seal means sealing with the mandrel.

14. Apparatus according to claim 13, said floating seal means including a tubular body having axially spaced inner and outer radial flanges, said upper seal means abutting against one of said flanges and said lower seal means abutting against the other of said flanges, said seal means being axially displaced relative to each other.

15. Apparatus according to claim 14 said upper seal means including packing rings at both sides of said inner flange, said lower seal means including packing rings at both sides of said outer flange.

16. Apparatus according to claim 15, said floating seal means including compression rings and releasable retainers at the ends of the packing rings to hold same against said flanges.

17. A drill string vibration damper comprising a splined tubular telescopic joint and spring means urging the joint to a certain position upon both extension and contraction of the joint with equal force exerted by said spring means upon equal departures from said certain position by extension and by contraction of the joint, said spring means comprising a plurality of elastomer metal sandwiches, each sandwich including upper and lower metal washers with an ovoid cross-section elastomer ring therebetween, each upper washer having a depending flange from one of its inner and outer peripheries and said lower washer having an upstanding flange at its opposite periphery, said flanges overlapping said washers, and spacer washers disposed between groups of said sandwiches, the inner peripheral flanges engaging each other and the outer peripheral flanges engaging each other within each group of said washers whereby said sandwiches in each group are not in parallel, said spacer washers having inner and outer peripheries clear of the travel paths of said flanges whereby said groups are in series.

18. Well tool comprising a splined tubular telescopic joint and resilient means to transmit force between axially movable members forming the joint with axially spaced seal means between said members defining a lubricant chamber housing said resilient means, the outer one of said members having a wash pipe extending within the other of said members, one of said seal means being a floating seal disposed between said wash pipe and said other member, said floating seal means being provided with a permanent magnet to indicate its position through said wash pipe, said wash pipe being paramagnetic.

19. Apparatus according to claim 18, said floating seal means comprising a support tube having first flexible seal means at its inner periphery for sealing with one of said members and second flexible seal means at its outer periphery for sealing with the other of said members, said first flexible seal means being axially displaced relative to the other of said flexible seal means.

20. Well tool comprising a splined tubular telescopic joint and resilient means to transmit force between axially moveable members forming the joint with axially spaced seal means between said members defining a lubricated chamber housing said resilient means, said spring means comprising a plurality of elastomer metal sandwichs, each sandwich including upper and lower metal washers with an ovoid cross-section elastomer ring therebetween, each upper washer having a depending flange from one of its inner and outer peripheries and said lower washer having an upstanding flange at its opposite periphery, said flanges overlapping said washers and spacer washers disposed between groups of said sandwiches, the inner peripheral flanges engaging each other and the outer peripheral flanges engaging each other within each group of said washers whereby said sandwichs in each group are in parallel, said spacer washers having inner and outer peripheries clear of the travel paths of said flanges whereby said groups are in series.

21. Well tool comprising a splined tubular telescopic joint and resilient means to transmit force between axially movable members forming the joint, said resilient means comprising a first variable Hooke's modulus spring means and a second variable Hooke's modulus spring means, said variable Hooke's modulus spring means being separate and in parallel, said tool having a lower spring rate at certain deflections than the spring rate for either of said resilient means alone at the same deflection.

22. Tool according to claim 19, each said variable modulus spring means comprising a stack of seriate ring elements, the ring elements of the stack of the first variable modulus spring means being out of contact with the ring elements of the stack of the second variable modulus spring means.

23. Tool according to claim 22, each of said stacks comprising a plurality of metal-resilient plastic material sandwiches.

24. A drill string cushioning tool comprising a telescopic joint including inner and outer tubular members and means to transmit torque between said members and to cushion the transmission of compression from one end of the joint to the other, a plurality of seal means sealing between the members and defining volume between said members adapted to receive lubricating fluid, one of said seal means being sliding pressure seal means and the other of said seal means being floating seal means, and magnet means carried by said floating seal means to facilitate determination of the position of the floating seal means.

25. Tool according to claim 24, said outer tubular member including a tube extending inside the end of said inner tubular member, said floating seal means comprising annular means around the outside of said tube and inside said outer tubular member, said magnet means comprising a permanent magnet carried by said annular means.

26. A drill string cushioning tool comprising: a telescopic joint including inner and outer tubular members and means to transmit torque between said members and to cushion the transmission of compression from one end of the joint to the other, axially spaced bearing means between the members to transmit bending moment therebetween, a plurality of seal means sealing between the members and defining volume between said members adapted to receive lubricating fluid, one of said seal means being sliding pressure seal means and the other of said seal means being floating seal means, said floating seal means being located axially beyond the portion of said tool that is between said bearing means, said floating seal means comprising:

a metal support tube having a larger inner diameter than the outer diameter of the portion of the one of said members with which the floating seal means seals and having a smaller outer diameter than the inner diameter of the portion of the other of said members with which the floating seal means seals, first annular flexible seal means about said tube at its inner periphery adjacent only one end of the tube and protruding radially inwardly from the tube for sealing with said portion of said one of said members therewithin, second annular flexible seal means about said tube at its outer periphery adjacent only the other end of the tube protruding radially outwardly from the tube for sealing with said portion of said other portion of said other of said members thereabout, said first fiexible seal means being axially displaced relative to said second flexible seal means, the outer periphery of said floating seal means at the same distance from said one end of said floating seal means as is said first flexible seal means having an outer diameter no larger than the outer diameter of said tube, and the inner periphery of said floating seal means at the same distance from said other end of said floating seal means as is said second flexible seal means having an inner diameter no larger than the inner diameter of said tube, whereby the tube is free to cant between said members, and medial seal means about the inner and outer peripheries of said support tube at the midportion thereof, said medial seal means including outer annular flexible seal means about the outer periphery of the midportion of the support tube protruding radially outwardly from the support tube for sealing with the outer tubular member and inner annular flexible seal means about the inner periphery of the midportion of the support tube protruding radially inwardly from the support tube for sealing with the inner tubular member, said medial seal means providing means to position the midportion of the support tube out of contact with said inner and outer tubular members.

27. Well tool seal cartridge for sealing between an inner tube and an outer tube radially separated therefrom, said cartridge including a metal support tube, first annular flexible seal means about said tube at its inner periphery adjacent only one end of the tube and protruding radially inwardly from the tube for sealing with said inner tube therewithin, second annular flexible seal means about said tube at its outer periphery adjacent only the other end the tube protruding radially outwardly from the tube for sealing with said outer tube thereabout, said first flexible seal means being axially displaced relative to said second flexible seal means, the outer periphery of said floating seal means at the same distance from said one end of said floating seal means as is said first flexible seal means having an outer diameter no larger than the outer diameter of said tube, and the inner periphery of said floating seal means at the same distance from said other end of said floating seal means as is said second flexible seal means having an inner diameter no larger than the inner diameter of said tube, whereby the tube is free to cant between said members, and medial seal means about the inner and outer peripheries of said support tube at the midportion thereof, said medial seal means including outer annular flexible seal means about the outer periphery of the midportion of the support tube protruding radially outwardly from the support tube for sealing with the outer tube and inner annular flexible seal means about the inner periphery of the midportion of the support tube protruding radially inwardly from the support tube for sealing with the inner tube, said medial seal means providing means to position the midportion of the support tube out of contact with said inner and outer tubes.

28. Well tool seal cartridge for sealing between an inner tube and an outer tube thereabout radially separated therefrom, said cartridge including a support tube, annular seal means carried by said support tube for sealing with said inner and outer tubes, and radially magnetized annularly disposed permanent magnet means carried by and concentric with said support tube for indicating the axial position of said seal cartridge between said inner and outer tubes.

29. A drill string damper comprising:

a tubular telescopic joint, said telescopic joint including a lower mandrel member and an upper barrel member therearound, means to transmit torque between said members while allowing relative axial sliding thereof, and resilient means to transmit axial force through the joint, axially spaced annular seal means sealing between the mandrel and barrel defining a volume between said mandrel and barrel adapted to receive lubricating fluid, said resilient means being disposed in said volume, one of said seal means being axially sliding pressure seal means and the other of said seal means being floating seal means, said barrel including a wash pipe extending inside the end of said mandrel, said floating seal means comprising annular means around the outside of the wash pipe and inside the mandrel, both of said seal means having lower and upper faces disposed with their upper faces to be adjacent lubricant when said volume is filled with lubricant and with their lower surfaces positioned to contact drilling fluid whereby particulates carried by drilling fluid both inside and outside the joint will fall away from the seal means.

30. A drill string vibration damper according to claim 34, said means to transmit torque comprising a splined tubular telescopic joint, said resilient means urging the joint back to a certain position upon both extension and contraction of the joint with equal force exerted by said spring means upon equal departures away from said certain position by extension and by contraction of the joint.

31. Damper according to claim 29, including an electrical conductor extending from the exterior of said joint to said volume and electrically insulated from said joint, said joint members being made of steel.

32. A drill string damper comprising a tubular telescopic joint, said telescopic joint including a mandrel member and a barrel member therearound, means to transmit torque between said members while allowing relative axial sliding thereof, and resilient means to transmit axial force through the joint, axially spaced annular seal means sealing between the mandrel and barrel defining a volume between said mandrel and barrel adapted to receive lubricating fluid, said resilient means being disposed in said volume, one of said seal means being an axially sliding pressure seal means and the other of said seal means being floating seal means, and means for determining the condition of said seals as indicated by leakage of contaminant into said volume including an electrical conductor extending from the exterior of said barrel to said volume and terminating thereat adjacent the lowermost of said seal means, said barrel member being electrically conductive and said electrical conductor being electrically insulated from said barrel.

33. Tool useful in earth boring by the rotary system comprising:

telescopically disposed mandrel and barrel members forming a telescopic joint, connection means at one end of each member for making connection with a rotary drill string component, means for transmitting torque between said members while allowing relative axial motion therebetween, resilient means for resiliently transmitting axial forces between said members upon relative axial motion of said members in both directions from a neutral position of minimum stress of said resilient means, said resilient means being separate from the last mentioned means, said resilient means having a like variable spring modulus upon both extension and contraction with a lowest modulus at the neutral position and nearly as low like moduluses at equal departures from neutral position to both sides of the neutral position over a range of such departures and like gradually and then sharply higher moduluses upon increasing equal departures beyond said range upon further extension and contraction of the damper, the increase in spring modulus being equal upon equal departures from said neutral position by way of extension and contraction, said resilient means comprising series stacked spring rings urging the join back to said neutral position upon both extension and contraction of the joint away from said neutral position, the unstressed length of the stack of spring rings that is stressed upon extension of the joint equaling the unstressed length of the stack of spring rings that is strained upon contraction of the joint, said spring rings urging said members back to said neutral position upon both extension and contraction of the joint with equal force exerted by said spring means upon equal departures away from said certain position by extension and by contraction of the joint.

34. Tool according to claim 33, sliding pressure seal means between said members sealing said flow passage against fluid flow from said passage outwardly through said tool between said elements and vice versa, floating seal means between said members forming with said pressure seal means an annular chamber between said members, being thereby adapted to receive lubricant in said chamber, said resilient means being disposed in said chamber with said mandrel extending through said rings, said resilient means being at all times, as said barrel and mandrel members move axially relative to each other, radially spaced from one of said members to provide a passage for the free flow of lubricant through said chamber, and said resilient means being at all times freely movable axially relative to the other of said members but fitting closely therewith to limit lateral movement of the rings by making line contact with said one of said members, the radial clearance between said resilient means and said other of said members being greater than that between said resilient means and said one of said members, the radial clearance between said resilient means and said other of said members being of the order of several thousandths of an inch, whereby said rings are guided by said one of said members to prevent buckling of said stack and cocking of the rings between said members and binding of said rings on said one of said members is avoided.

35. Tool according to claim 33, said telescopic joint including stop means limiting extension and contraction of said joint, said resilient means having a spring rate in excess of 100,000 lb./in. at the limits of extension and contraction of the joint imposed by said stop means, said resilient means having a spring rate of less than 10,000 lb./in. over a one inch range of deflections extending from one-half inch contraction to one-half inch extension from said neutral position.

36. Tool according to claim 35, said mandrel and barrel members being tubular providing a flow passage therethrough, sliding pressure seal means between said members sealing said flow passage against fluid flow from said passage outwardly through said tool between said elements and vice versa, and floating seal means between said members forming with said pressure seal means an annular chamber between said members adapted to receive and retain lubricant, said resilient means being disposeed of in said chamber, said resilient means being at all times, as said members move axially relative to each other, radially spaced from one of said members and freely movable axially relative to the other said members.

* * * * *

UNITED STATES PATENT AND TRADEMARK OFFICE

CERTIFICATE OF CORRECTION

PATENT NO. : 4,281,726

DATED : August 4, 1981

INVENTOR(S) : William R. Garrett

It is certified that error appears in the above—identified patent and that said Letters Patent is hereby corrected as shown below:

Column 6, line 48: before "neutral" insert -its-.

Column 6, line 56: change "publcation" to -publication-.

Column 9, line 54: change "33" to -3'-.

Column 16, line 41: change "165" to -164-.

Column 18, line 28: change "flat" to -fit-.

Column 20, line 7: change "betweenthe" to -between the-.

Column 28, line 56: change "19" to -21-.

Column 31, line 9: change "34" to -29-.

Column 31, line 68: change "join" to -joint-.

Signed and Sealed this

*Fifth* Day of *April 1983*

[SEAL]

*Attest:*

GERALD J. MOSSINGHOFF

*Attesting Officer*

*Commissioner of Patents and Trademarks*